US009007360B2

(12) United States Patent
Ota et al.

(10) Patent No.: US 9,007,360 B2
(45) Date of Patent: Apr. 14, 2015

(54) ELECTROOPTIC DEVICE, METHOD FOR DRIVING ELECTROOPTIC DEVICE AND ELECTRONIC APPARATUS

(71) Applicant: Seiko Epson Corporation, Tokyo (JP)

(72) Inventors: Hitoshi Ota, Shiojiri (JP); Shin Fujita, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 298 days.

(21) Appl. No.: 13/754,463

(22) Filed: Jan. 30, 2013

(65) Prior Publication Data

US 2013/0207564 A1 Aug. 15, 2013

(30) Foreign Application Priority Data

Feb. 13, 2012 (JP) ..... 2012-028097

(51) Int. Cl.
*G09G 5/00* (2006.01)
*H05B 37/02* (2006.01)
*G09G 3/32* (2006.01)

(52) U.S. Cl.
CPC ..... *H05B 37/02* (2013.01); *G09G 3/3241* (2013.01); *G09G 3/3291* (2013.01); *G09G 2300/0814* (2013.01); *G09G 2300/0819* (2013.01); *G09G 2300/0861* (2013.01); *G09G 2320/0233* (2013.01); *G09G 2320/045* (2013.01)

(58) Field of Classification Search
USPC ..... 315/224, 225; 345/46, 48, 204, 214
See application file for complete search history.

(56) References Cited

U.S. PATENT DOCUMENTS

| | | | | |
|---|---|---|---|---|
| 6,380,919 | B1 * | 4/2002 | Koyama et al. | 345/92 |
| 7,928,951 | B2 * | 4/2011 | Fujita | 345/98 |
| 8,497,856 | B2 * | 7/2013 | Ota | 345/212 |
| 8,553,023 | B2 * | 10/2013 | Yoshizaki et al. | 345/211 |
| 2007/0273619 | A1 | 11/2007 | Kitazawa et al. | |
| 2010/0045646 | A1 | 2/2010 | Kishi | |
| 2011/0050741 | A1 | 3/2011 | Jeong | |
| 2013/0093737 | A1 | 4/2013 | Ota et al. | |

FOREIGN PATENT DOCUMENTS

| | | |
|---|---|---|
| JP | A-2005-352411 | 12/2005 |
| JP | A-2007-316462 | 12/2007 |
| JP | A-2011-053635 | 3/2011 |
| WO | WO 2008/108024 A1 | 9/2008 |

* cited by examiner

*Primary Examiner* — Hai L Nguyen
(74) *Attorney, Agent, or Firm* — Oliff PLC

(57) ABSTRACT

An electrooptic device has a data line, a pixel circuit and a driver circuit which drives the pixel circuit. The driver circuit has a first feeder line, a level shift circuit to be electrically coupled with the data line and a driving control circuit which provides the first feeder line with a first voltage or a second voltage and controls operations of the level shift circuit and the pixel circuit. The level shift circuit has a second holding capacitor and a switch section which switches over condition of a connection between the second holding capacitor and the first feeder line.

20 Claims, 17 Drawing Sheets

<(a) PERIOD FOR LIGHT EMISSION>

<(b) PERIOD FOR INITIALIZATION>

<(c) PERIOD FOR COMPENSATION>

<(d) PERIOD FOR WRITING>

<(a) PERIOD FOR LIGHT EMISSION>

<(b) PERIOD FOR INITIALIZATION>

<(c) PERIOD FOR COMPENSATION>

<(d) PERIOD FOR WRITING>

ELECTROOPTIC DEVICE, METHOD FOR DRIVING ELECTROOPTIC DEVICE AND ELECTRONIC APPARATUS

BACKGROUND

1. Technical Field

The present invention relates to an electrooptic device, a method for driving an electrooptic device and an electronic apparatus.

2. Related Art

Various kinds of electrooptic devices using light emitting elements including an organic light emitting diode (OLED) are proposed in recent years. Such an electrooptic device is generally structured to be provided with a pixel circuit including the light emitting element described above, a transistor, etc., correspondingly to a crossing of a scan line and a data line correspondingly to a pixel of an image to be displayed, e.g., as disclosed in JP-A-2007-316462.

Incidentally, a demand for application of an electrooptic device using a light emitting element to a small-sized apparatus such as a portable apparatus, a head mounted display, etc., grows in recent years. In this case, it is necessary to downsize the electrooptic device without degrading a display quality. Further, it is desirable to give the electrooptic device a simple structure in order to downsize the electrooptic device while keeping a manufacturing cost low.

SUMMARY

An advantage of some aspects of the invention is to put downsizing and simplification of an electrooptic device into practice without degrading a display quality.

In order to achieve the above advantage, an electrooptic device of the invention is an electrooptic device having a plurality of scan lines, a plurality of data lines, a plurality of pixel circuits provided correspondingly to crossings of the plural scan lines and the plural data lines, and a driver circuit which drives the plural pixel circuits. The plural pixel circuits each have a driving transistor which makes a current according to a gate-source voltage flow, a writing transistor electrically coupled with and between a gate of the driving transistor and the data line, a first holding capacitor having one end electrically coupled with the gate of the driving transistor which holds the gate-source voltage of the driving transistor, and a light emitting element which emits light with brightness according to magnitude of the current provided by the driving transistor. The driver circuit has a first feeder line, a level shift circuit to be electrically coupled with the plural data lines, and a driving control circuit which provides the first feeder line with a first voltage or a second voltage and controls operations of the level shift circuit and the pixel circuit. The level shift circuit has a plurality of second holding capacitors each provided correspondingly to each of the plural data lines and a switch section which switches between closed and open conditions between both ends of the second holding capacitor and the first feeder line. The plural second holding capacitors each have one end coupled with the data line and another end on which a signal of a voltage which specifies the brightness of the light emitting element is provided. The driving control circuit controls the switch section so as to electrically couple the first feeder line with the one end of the second holding capacitor in part or all of a period of time in which the first feeder line is provided with the first voltage, and controls the switch section so as to electrically couple the first feeder line with the other end of the second holding capacitor in part or all of a period of time in which the first feeder line is provided with the second voltage.

According to the invention, as the first feeder line is electrically coupled with the one end of the second holding capacitor in the period of time in which the first feeder line is provided with the first voltage and the first feeder line is electrically coupled with the other end of the second holding capacitor in the period of time in which the first feeder line is provided with the second voltage, the one end and the other end of the second holding capacitor can be provided with the first voltage and the second voltage, respectively, by means of the one first feeder line.

The electrooptic device can thereby be downsized and simplified as compared with a case where feeder lines which provide the one end and the other end of the second holding capacitor with the first and second voltages, respectively, are provided separately.

Further, it is preferable for the switch section of the electrooptic device described above to have a first transistor electrically coupled with and between the one end of the second holding capacitor and the first feeder line and a second transistor electrically coupled with and between the other end of the second holding capacitor and the first feeder line.

According to the invention, closed and open conditions between the one end of the second holding capacitor and the first feeder line and closed and open conditions between the other end of the second holding capacitor and the first feeder line can be easily controlled.

Further, it is preferable for the electrooptic device described above to have third holding capacitors each provided correspondingly to each of the plural data lines which each hold a voltage on each of the data lines.

According to the invention, the data line is coupled with the third holding capacitor and the one end of the second holding capacitor. Thus, if the second holding capacitor is provided on the other end with a signal of a voltage which specifies brightness of the light emitting element, a width of a voltage change on the data line is a value into which a width of a voltage change of a signal of a voltage which specifies the brightness of the light emitting element is compressed according to a capacitance ratio of the second and third holding capacitors. That is, the width of the voltage change on the data line is narrowed down as compared with the width of the voltage change of the signal of the voltage which specifies the brightness of the light emitting element. The voltage can thereby be set on the gate node of the driving transistor with fine degrees even if the data signal is not marked with fine degrees, the light emitting element can be provided with a precise current and display of a high quality is enabled.

Incidentally, the electrooptic device of the invention selects a voltage on the gate node of the driving transistor by providing the first and third holding capacitors with electric charges from the one end of the second holding capacitor via the data line. Specifically, the voltage on the gate node of the driving transistor is determined depending upon the capacitance values of the first and third holding capacitors and a quantity of electric charges that the second holding capacitor provides the first and third holding capacitors with.

If the electrooptic device lacks the third holding capacitor, the voltage on the gate node of the driving transistor is determined depending upon the capacitance value of the first holding capacitor and the electric charges provided by the second holding capacitor. Thus, if the capacitance value of the first holding capacitor relatively varies in every one of the pixel circuits because of an error in a semiconductor process, the voltage on the gate node of the driving transistor varies in every one of the pixel circuits as well. In this case, display unevenness occurs and the display quality is degraded.

Meanwhile, the third holding capacitor which holds the voltage on the data line is provided according to the invention. As being provided correspondingly to each of the data lines, the third holding capacitor can be structured to have an electrode of a greater size as compared with the first holding capacitor provided in the pixel circuit. Thus, relative variations in the capacitance values of the plural third holding capacitors provided to respective columns caused by an error in the semiconductor process can be suppressed as compared with the first holding capacitors. The voltage on the gate node of the driving transistor can thereby be prevented from varying in every pixel circuit, and display of a high quality in which display unevenness is prevented from occurring is enabled.

Further, it is preferable for the driving control circuit of the electrooptic device described above to provide the first feeder line with the first voltage and to control the switch section so as to electrically couple the first feeder line with the one end of the second holding capacitor in a first period of time, to provide the first feeder line with the second voltage and to control the switch section so as to electrically couple the first feeder line with the other end of the second holding capacitor in condition that the writing transistor is kept on in a second period of time which starts after the first period of time ends, and to electrically decouple the first feeder line with the both ends of the second holding capacitor and to provide the other end of the second holding capacitor with a signal of a voltage which specifies brightness of the light emitting element in condition that the writing transistor is kept on in a third period of time which starts after the second period of time ends.

According to the invention, voltages on the first, second and third holding capacitors, the data line and the gate node of the driving transistor are initialized in the first and second periods of time, and then the other end of the second holding capacitor is provided with a signal of a voltage which specifies brightness of the light emitting element in the third period of time. As the voltage on the gate node of the driving transistor is thereby precisely set to a value corresponding to the signal of the voltage which specifies brightness of the light emitting element, display of a high quality is enabled.

Further, it is preferable for the level shift circuit of the electrooptic device described above to have a plurality of fourth holding capacitors each provided correspondingly to each of the plural data lines, and it is preferable for each of the plural fourth holding capacitors to be provided on one end with a voltage according to the data signal outputted by the driving control circuit in a period of time since a start of the first period of time and until a start of the third period of time, and to be electrically coupled on the one end with the other end of the second holding capacitor in the third period of time.

According to the invention, the data signal is provided to the one end of the fourth holding capacitor and is temporarily held in the first and second periods of time, and is provided to the gate node of the driving transistor in the third period of time.

If the electrooptic device lacks the fourth holding capacitor, all operations to provide the gate node of the driving transistor with the data signal have to be carried out in the third period of time, and it is necessary to set the length of the third period of time long enough.

Meanwhile, as the operations to provide the data signal and to initialize the data lines, etc., are carried out parallel in the first and second periods of time according to the invention, a temporal limitation imposed on the operation to be carried out in one period for horizontal scanning can be alleviated. The operation to provide the data signal can thereby be slowed down and a period of time for initializing the data lines, etc., can be secured enough.

Further, the driver circuit of the electrooptic device described above has a plurality of paired first and second switches each provided correspondingly to each of the plural fourth holding capacitors. An output end of the first switch is electrically coupled with the other end of the second holding capacitor. An input end of the first switch is electrically coupled with the one end of the fourth holding capacitor and an output end of the second switch. The driving control circuit may be configured to turn the second switch on and to provide the input end of the second switch with the data signal in condition that the first switch is kept off in the period of time since the start of the first period of time and until the start of the third period of time, and to turn the first switch on in condition that the second switch is kept off in the third period of time.

Further, every particular number of the plural data lines of the electrooptic device described above are gathered into a group, and the input ends of the particular number of the second switches corresponding to the particular number of the data lines belonging to one group are coupled with one another in common. The driving control circuit may be configured to turn the particular number of the second switches belonging to one group on in particular order as being synchronized with the supply of the data signal.

Further, the pixel circuit of the electrooptic device described above has a threshold compensation transistor electrically coupled with and between the gate and the source of the driving transistor, and it is preferable for the driving control circuit to keep the threshold compensation transistor on in the second period of time and to keep the threshold compensation transistor off in the periods of time except for the second period of time.

According to the invention, the voltage on the gate of the driving transistor can be made a voltage corresponding to the threshold voltage of the driving transistor, and a variation in the threshold voltage of every one of the driving transistors can be compensated.

Further, the electrooptic device described above has a plurality of second feeder lines each provided correspondingly to each of the plural data lines which provides a particular reset voltage. The pixel circuit has an initializing transistor electrically coupled with and between the second feeder line and the light emitting element. It is preferable for the driving control circuit to keep the initializing transistor on at least a portion of the first to third periods of time.

According to the invention, an effect of a voltage held by a capacitor which lives on the light emitting element can be suppressed.

Further, the plural second feeder lines of the electrooptic device described above are each provided along each of the plural data lines. It is preferable for the third holding capacitor to be formed by one of the plural data lines and one of the second feeder lines adjacent to each other.

According to the invention, as the third holding capacitor can be rendered large enough (i.e., larger than the first and second holding capacitors), a range of voltage change on the data line can be narrowed down significantly enough as compared with a range of voltage change of a signal of a voltage which specifies brightness of the light emitting element. The voltage can thereby be set on the gate node of the driving transistor with fine degrees even if the data signal is not marked with fine degrees.

Further if the third holding capacitor is rendered large enough, the voltage on the gate node of the driving transistor can be prevented from varying in every pixel circuit, and display of a high quality in which display unevenness is prevented from occurring is enabled.

Incidentally, the third holding capacitor may be formed by the data line and the second feeder line adjacent to each other provided in the same layer. Further, the third holding capacitor may be formed by the data line and the second feeder line adjacent to each other arranged as overlapping each other in a plan view.

Further, the pixel circuit of the electrooptic device described above has a light emission control transistor electrically coupled with and between the driving transistor and the light emitting element. It is preferable for the driving control circuit to keep the light emission control transistor off at least in a period of time since the start of the first period of time and until the end of the third period of time.

Further, a method for driving an electrooptic device of the invention is a method for driving an electrooptic device having a plurality of scan lines, a plurality of data lines, a plurality of pixel circuits provided correspondingly to crossings of the plural scan lines and the plural data lines, a first feeder line and a second holding capacitor having one end electrically coupled with the data line and provided on another end with a signal of a voltage which specifies brightness of the light emitting element. The plural pixel circuits each have a driving transistor which makes a current according to a gate-source voltage flow, a writing transistor electrically coupled with and between the gate of the driving transistor and the data line, a first holding capacitor having one end electrically coupled with the gate of the driving transistor which holds the gate-source voltage of the driving transistor, and a light emitting element which emits light with brightness according to magnitude of the current provided by the driving transistor. It is preferable to provide the first feeder line with a first voltage and to electrically couple the first feeder line with the one end of the second holding capacitor in a first period of time, and to provide the first feeder line with a second voltage and to electrically couple the first feeder line with the other end of the second holding capacitor in a second period of time which starts after the first period of time ends.

Incidentally, the invention can be thought as an electronic apparatus having the electrooptic device, as well as the electrooptic device. Typically, a head mounted display (HMD) or an electronic viewfinder can be enumerated as the electronic apparatus.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiments of the invention will be explained below with reference to the drawings.

First Embodiment

Figure 1:
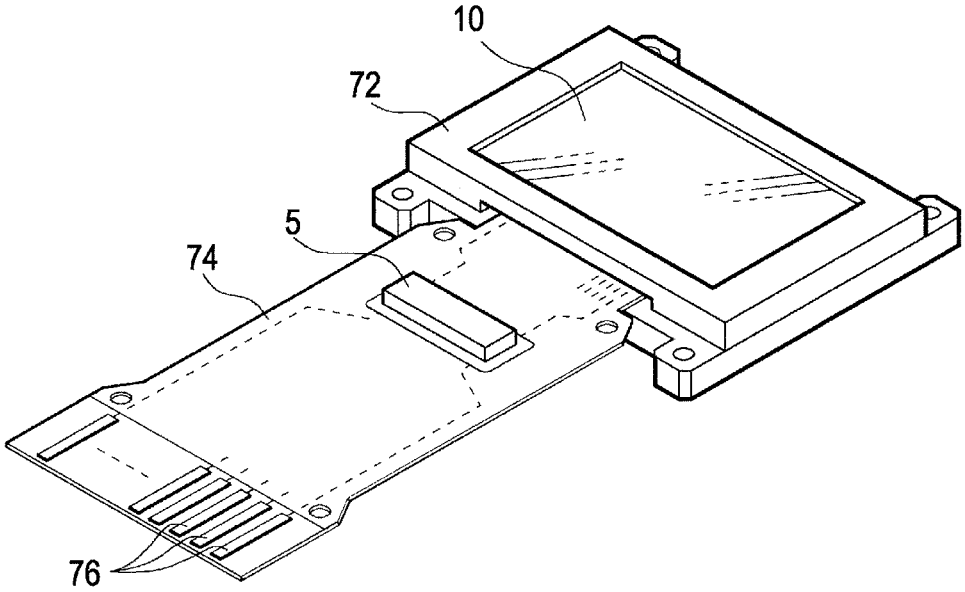
FIG. 1 is a perspective view which shows a structure of an electrooptic device of a first embodiment of the invention.

FIG. 1 is a perspective view which shows a structure of an electrooptic device 10 of an embodiment of the invention.

The electrooptic device 10 is a micro-display which displays an image, e.g., in a head mounted display. The electrooptic device 10 is an organic EL device in which a plurality of pixel circuits, driving circuits which drive the pixel circuits, etc., are formed, e.g., on a silicon substrate as described later in detail, and an exemplary light emitting element, an OLED, is used for the pixel circuit. The electrooptic device 10 is contained, e.g., in a frame-like case 72 which is open on a display section, and is connected with one end of an FPC (Flexible Printed Circuits) board 74. A control circuit 5 in a semiconductor chip is mounted on the FPC board 74 by means of COF (Chip On Film) technology, and the FPC board 74 is provided with a plurality of terminals 76 and is connected with an upper rank circuit which is omitted to be shown. The upper rank circuit provides the electrooptic device 10 via the plural terminals 76 with image data as being synchronized with a synchronization signal. The synchronization signal includes a vertical synchronization signal, a horizontal synchronization signal and a dot clock signal. Further, gradation levels of pixels of an image to be displayed are specified, e.g., in eight bits in the image data.

The control circuit 5 has functions of a power source circuit and a data signal output circuit of the electrooptic device 10 together. That is, the control circuit 5 provides the electrooptic device 10 with various kinds of control signals and voltages generated according to the synchronization signal, and converts digital image data into an analog data signal so as to provide the electrooptic device 10 with the analog data signal as well.

Figure 2:
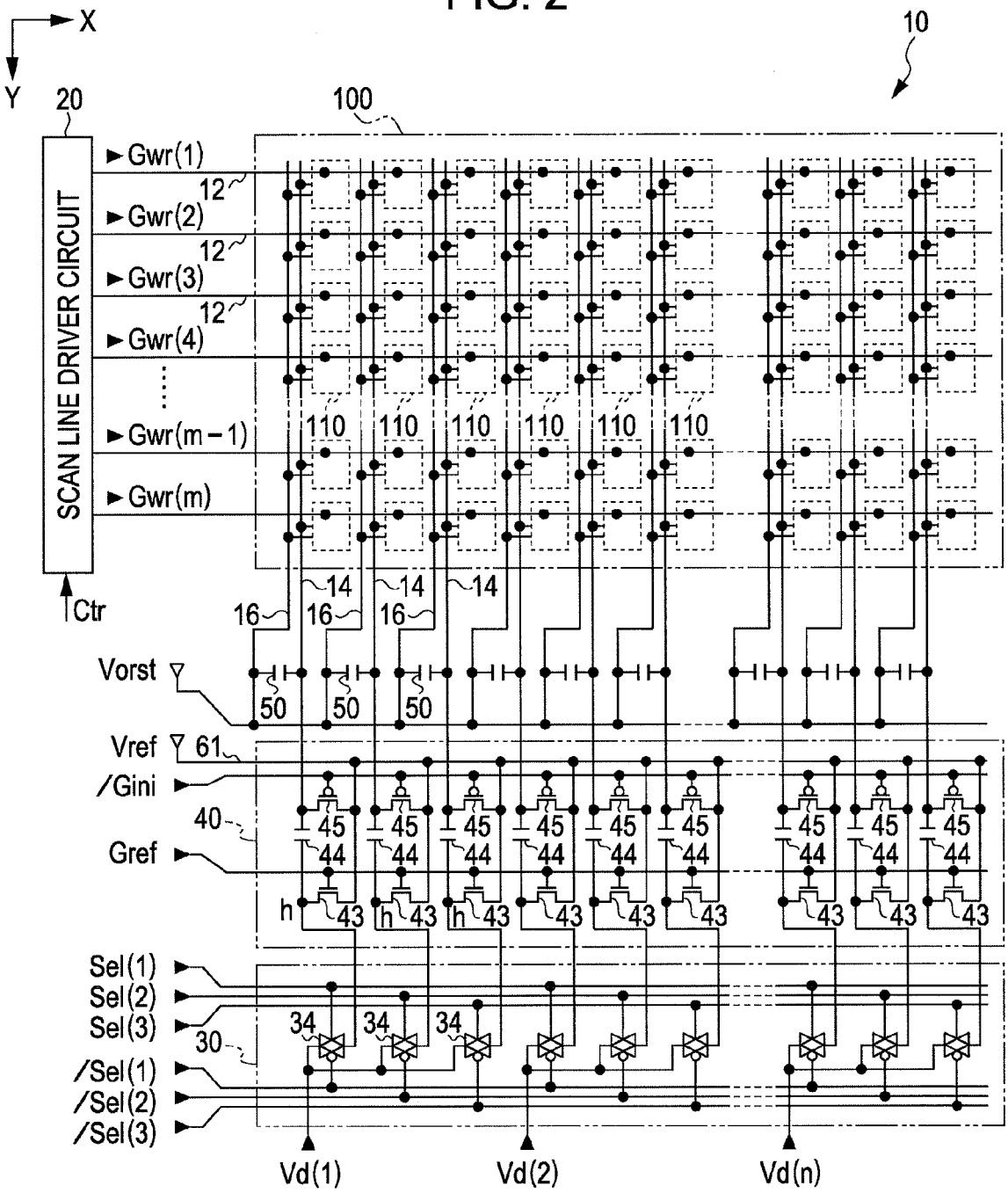
FIG. 2 shows a structure of the electrooptic device.

FIG. 2 shows a structure of the electrooptic device 10 of the first embodiment. As shown in this drawing, the electrooptic device 10 can be broadly divided into a scan line driver circuit 20, a demultiplexer 30, a level shift circuit 40 and a display section 100.

Among those portions, the display section 100 has pixel circuits 110 which each correspond to a pixel of an image to be displayed arranged in a matrix form. Speaking in detail, the display section 100 is provided with m-rows of scan lines 12 extended in a horizontal direction (X-direction) in the drawing and (3n)-columns of data lines 14 such that every three columns are grouped which are extended in a vertical direction (Y-direction) in the drawing and electrically isolated from the respective scan lines 12. Then, the pixel circuits 110 are provided correspondingly to the crossings between the scan lines 12 of m-rows and the data lines 14 of (3n)-columns.

Thus, the pixel circuits 110 of the embodiment are arranged in a matrix form of vertical m-rows and horizontal (3n)-columns.

The symbols m and n mentioned here are each an integer. The scan lines 12 and the rows of the matrix of the pixel circuits 110 are each sometimes called first, second, third through (m−1)-th and m-th rows in top to bottom order in the drawing so as to be distinguished from one another. The data lines 12 and the columns of the matrix of the pixel circuits 110 are each sometimes called first, second, third through (3n−1)-th and 3n-th columns in left to right order so as to be distinguished from one another. Further, if an integer j (1<=j<=n) is used for general explanation of the groups of the data lines 14, it can be said that (3j−2)-th, (3j−1)-th and 3j-th data lines 14 belong to the j-th group counted from the left.

Incidentally, three pixel circuits 110 corresponding to the crossings between one and the same row of the scan lines 12 and three columns of the data lines 14 belonging to the same group each correspond to one of R (red), G (green) and B (blue) pixels so as to indicate one dot of a color image to be displayed by the three pixels. That is, the embodiment employs a structure in which OLEDs corresponding to RGB emit light so as to indicate color of one dot by means of additive color mixture.

Further, as shown in FIG. 2, (3n)-columns of feeder lines 16 (second feeder lines) are provided in the display section 100 as extended in the vertical direction and electrically isolated from the respective scan lines 12. The respective feeder lines 16 are provided with a particular voltage Vorst as a reset voltage in common. The columns of the feeder lines 16 are each sometimes called first, second, third through (3n)-th and (3n+1)-th columns of the feeder lines 16 in left to right order in the drawing so as to be distinguished from one another. Each of the first through (3n)-th columns of the feeder lines 16 is provided along each of the first through (3n)-th columns of the data lines 14. That is, if an integer p is supposed (1<=p<=(3n)), the p-th column of the feeder lines 16 and the p-th column of the data lines 14 are provided adjacently to each other.

Further, the electrooptic device 10 is provided with (3n) holding capacitors 50 correspondingly to the respective ones of the first through (3n)-th columns of the data lines 14. One end of the holding capacitor 50 is connected with the data line 14, and another end of the holding capacitor 50 is connected with the feeder line 16. That is, the holding capacitor 50 functions as a third holding capacitor which holds a voltage on the data line 14. It is preferable to form the holding capacitor 50 by having an isolation material (dielectric material) between the feeder line 16 and the data line 14 adjacent to each other. In this case, a distance between the feeder line 16 and the data line 14 adjacent to each other is specified so that a necessary value of capacitance is obtained. Incidentally, the capacitance value of the holding capacitor 50 is written as Cdt below.

The holding capacitors 50 are provided outside the display section 100 in FIG. 2, which is just an equivalent circuit though, and the holding capacitors 50 may be provided inside the display section 100. Further, the holding capacitors 50 may be provided across the inside and outside of the display section 100.

The control circuit 5 provides the electrooptic device 10 with various kinds of control signals.

Specifically, the control circuit 5 provides the electrooptic device 10 with a control signal Ctr for controlling the scan line driver circuit 20, control signals Sel(1), Sel(2) and Sel(3) for controlling choice to be made on the demultiplexer 30, control signals /Sel(1), /Sel(2) and /Sel(3) into which those signals are logically inverted, a control signal /Gini of negative logic for controlling the level shift circuit 40, and a control signal Gref of positive logic. Incidentally, the control signal Ctr practically includes a plurality of signals such as a pulse signal, a clock signal, an enabling signal, etc.

Further, the control circuit 5 provides the electrooptic device 10 with data signals Vd(1) and Vd(2) through Vd(n). Specifically, the control circuit 5 provides the first and second through n-th groups with the data signals Vd(1) and Vd(2)-through Vd(n) as synchronized with choice timing on the demultiplexer 30. Incidentally, let the highest and lowest values of voltages that the data signals Vd(1)-through Vd(n) can be given be Vmax and Vmin, respectively.

The scan line driver circuit 20 generates, according to the control signal Ctr, scan signals for scanning every row of the scan lines 12 in turn over a period of time of a frame. The scan signals provided to the first, second, third through (m−1)-th and m-th rows of the scan lines 12 are written as Gwr(1), Gwr(2), Gwr(3)-through Gwr(m−1) and Gwr(m), respectively.

Incidentally, the scan line driver circuit 20 generates, in addition to the scan signals Gwr(1)-Gwr(m), various kinds of control signals synchronized with the scan signals for every row and provides the display section 100 with those signals, which is omitted to be shown in FIG. 2, though. Further, the period of time of a frame is a period of time that the electrooptic device 10 requires so as to display an image for one cut (frame). If the vertical synchronization signal included in the synchronization signals has a frequency of 120 Hz, the period of time of a frame is one cycle of 120 Hz, i.e., 8.3 milliseconds.

The demultiplexer 30 is a collection of transmission gates 34 (second switches) each provided for every column, and provides three columns forming every group with a data signal in turn.

Input ends of the transmission gates 34 mentioned here corresponding to the (3j−2)-th, (3j−1)-th and (3j)-th columns which belong to the j-th group are connected in common with one another. The common ends are each provided with a data signal Vd(j).

The transmission gate 34 provided on the (3j−2)-th column, the leftmost column in the j-th group, is turned on (closed) when the control signal Sel(1) is at H level (the control signal /Sel(1) is at L level). Similarly, the transmission gate 34 provided on the (3j−1)-th column, the central column in the j-th group, is turned on when the control signal Sel(2) is at H level (the control signal /Sel(2) is at L level), and the transmission gate 34 provided on the (3j)-th column, the rightmost column in the j-th group, is turned on when the control signal Sel(3) is at H level (the control signal /Sel(3) is at L level).

The level shift circuit 40 has a combination of a holding capacitor 44, a p-channel MOS transistor 45 (first transistor) and an n-channel MOS transistor 43 (second transistor) for every column, and shifts voltage of a data signal provided from an output end of the transmission gate 34 of each of the columns. While one end of the holding capacitor 44 mentioned here is connected with the data line 14 and a drain node of the transistor 45 of a corresponding one of the columns, another end of the holding capacitor 44 is connected with the output end of the transmission gate 34 and a drain node of the transistor 43. That is, the holding capacitor 44 functions as a second holding capacitor having one end connected with the data line 14. Let a capacitance value of the holding capacitor 44 be Crf1, although omitted to be shown in FIG. 2.

Source nodes of the transistors 45 of the respective columns are connected with a feeder line 61 (first feeder line) in common over the respective columns, and gate nodes are provided with the control signal /Gini in common over the respective columns. Thus, the transistor 45 electrically couples the one end of the holding capacitor 44 (and the data line 14) with the feeder line 61 when the control signal /Gini is at L level, and electrically decouples them when the control signal /Gini is at H level.

Further, source nodes of the transistors 43 of the respective columns are connected with the feeder line 61 in common over the respective columns, and gate nodes are provided with the control signal Gref in common over the respective columns. Thus, the transistor 43 electrically couples a node h, i.e., the other end of the holding capacitor 44 with the feeder line 61 when the control signal Gref is at H level, and electrically decouples them when the control signal Gref is at L level.

That is, the transistors 45 and 43 function as a switch section which switches between closed and open conditions between the both ends of the holding capacitor 44 and the feeder line 61.

Incidentally, the control circuit 5 provides the feeder line 61 with either one of voltages Vref_H (first voltage) and Vref_L (second voltage). Incidentally, the voltages Vref_H and Vref_L are collectively called a voltage Vref in some cases below.

As described above, the control circuit 5, the scan line driver circuit 20, the demultiplexer 30 and the level shift circuit 40 function as a driver circuit which drives the pixel circuits 110.

Further, the control circuit 5 and the scan line driver circuit 20 are called a driving control circuit which controls operations of the pixel circuits 110, the demultiplexer 30 and the level shift circuit 40 in some cases.

The pixel circuit 110 will be explained with reference to FIG. 3. As the respective pixel circuits 110 are structured the same as one another from an electrical viewpoint, the pixel circuit 110 located on the i-th row and (3j−2)-th column in the j-th group, i.e., on the i-th row and (3j−2)-th column will be explained as an example. Incidentally, the symbol i generally indicates a row on which the pixel circuits 110 are arranged, and is an integer 1<=i<=m.

Figure 3:
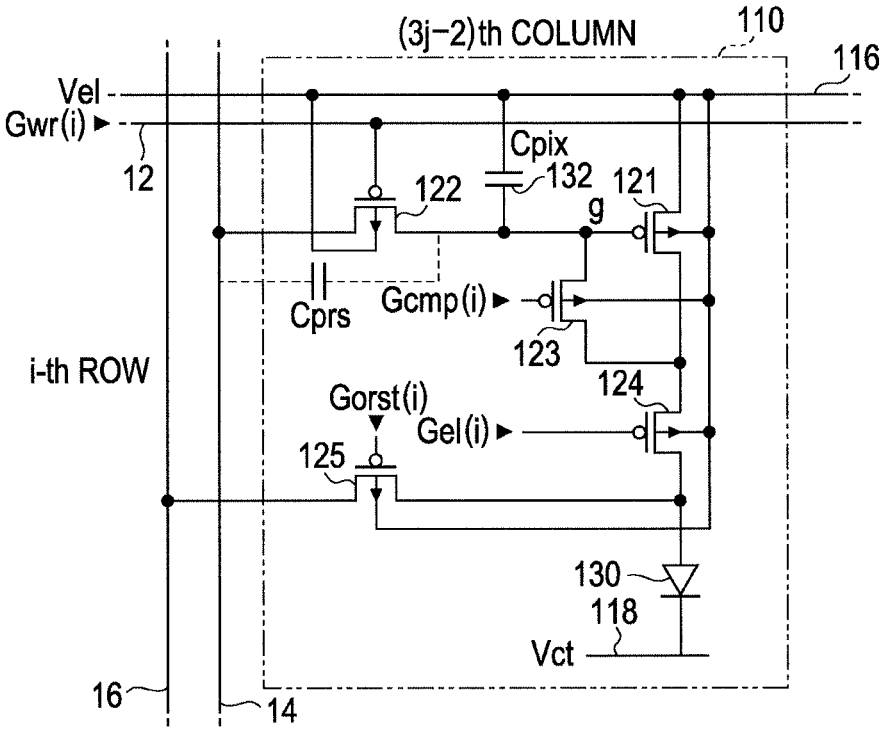
FIG. 3 shows a pixel circuit in the electrooptic device.

As shown in FIG. 3, the pixel circuit 110 has p-channel MOS transistors 121-125, an OLED 130 and a holding capacitor 132. The pixel circuit 110 is provided with a scan signal Gwr(i) and control signals Gel(i), Gcmp(i) and Gorst (i). The scan signal Gwr(i) and the control signals Gel(i), Gcmp(i) and Gorst(i) mentioned here are each provided by the scan line driver circuit 20 correspondingly to the i-th row. Thus, the scan signal Gwr(i) and the control signals Gel(i), Gcmp(i) and Gorst(i) are provided to pixel circuits on other columns as well in common, as long as on the i-th row, except for the (3j−2)-th column being paid attention to.

As for the transistor 122, the gate node is coupled with the scan line 12 on the i-th row, the one of the drain and the source node is coupled with the data line 14 on the (3j−2)-th column, and the other is coupled with the gate node g in the transistor 121, one end of the holding capacitor 132 and one of the source and drain nodes of the transistor 123. That is, the transistor 122 functions as a writing transistor electrically coupled with and between the gate node g of the transistor 121 and the data line 14 which controls electric connection between the gate node g of the transistor 121 and the data line 14. The gate node of the transistor 121 mentioned here is written as g so as to be distinguished from other nodes.

As for the transistor 121, the source node is coupled with a feeder line 116, and the drain node is coupled with the other of the source and drain nodes of the transistor 123 and with the source node of the transistor 124. The feeder line 116 mentioned here is supplied with a voltage Vel which is the upper side of the power source. That is, the transistor 121 functions as a driving transistor which lets a current according to the voltage between the gate and source nodes of the transistor 121 flow.

The gate node of the transistor 123 is provided with a control signal Gcmp(i). The transistor 123 functions as a threshold compensation transistor which controls electric connection between the source node and the gate node g of the transistor 121.

The gate node of the transistor 124 is provided with a control signal Gel(i), and the drain node is individually coupled with the source node of the transistor 125 and with the anode of the OLED 130. That is, the transistor 124 functions as a light emission control transistor which controls electric connection between the drain node of the transistor 121 and the anode of the OLED 130.

The gate node of the transistor 125 is provided with a control signal Gorst(i) corresponding to the i-th row, and the drain node is coupled with the feeder line 16 on the (3j−1)-th column and is kept at a voltage Vorst. The transistor 125 functions as an initializing transistor which controls the electric connection between the feeder line 16 and the anode of the OLED 130.

As the electrooptic device 10 of the embodiment is formed on a silicon substrate, the transistors 121-125 are at the voltage Vel, i.e., the substrate voltage.

One end of the holding capacitor 132 is coupled with the gate node g of the transistor 121 and another end is coupled with the feeder line 116. Thus, the holding capacitor 132 functions as a first holding capacitor which holds voltage between the gate and the source of the transistor 121. Incidentally, the capacitance value of the holding capacitor 132 is written as Cpix. At this time, the capacitance values Cdt, Crf1 and Cpix of the holding capacitors 50, 44 and 132, respectively, are set according to the following inequality.

$$Cdt > Crf1 >> Cpix$$

That is, they are set in such a way that Cdt is greater than Crf1, and that Cpix is significantly smaller than Cdt and Crf1. Incidentally, a parasitic capacitor relying on the gate node g of the transistor 121 may be used as the holding capacitor 132, and so may a capacitor formed by conductive layers of the silicon substrate different from each other between which an isolation layer is held.

The anode of the OLED 130 is a pixel electrode individually provided to every one of the pixel circuits 110. Meanwhile, the cathode of the OLED 130 is a common electrode 118 common to all the pixel circuits 110, and remains at a voltage Vct which is the lower side of the power source in the pixel circuit 110.

The OLED 130 is formed by the anode and the cathode having optical transparency between which a white organic EL layer is held. Then, the OLED 130 is overlaid on its light emitting side (cathode side) with a color filter corresponding to one of RGB colors.

If current flows from the anode to the cathode in the OLED 130 described above, a positive hole injected from the anode is coupled again with an electron injected from the cathode in the organic EL layer, resulting in that an exciton is generated and white light is born. The white light born at this time passes the cathode opposite the silicon substrate (anode), gets colored by means of the color filter and is observed on an observer side in the structure of the OLED 130.

Operation of the First Embodiment

Figure 4:
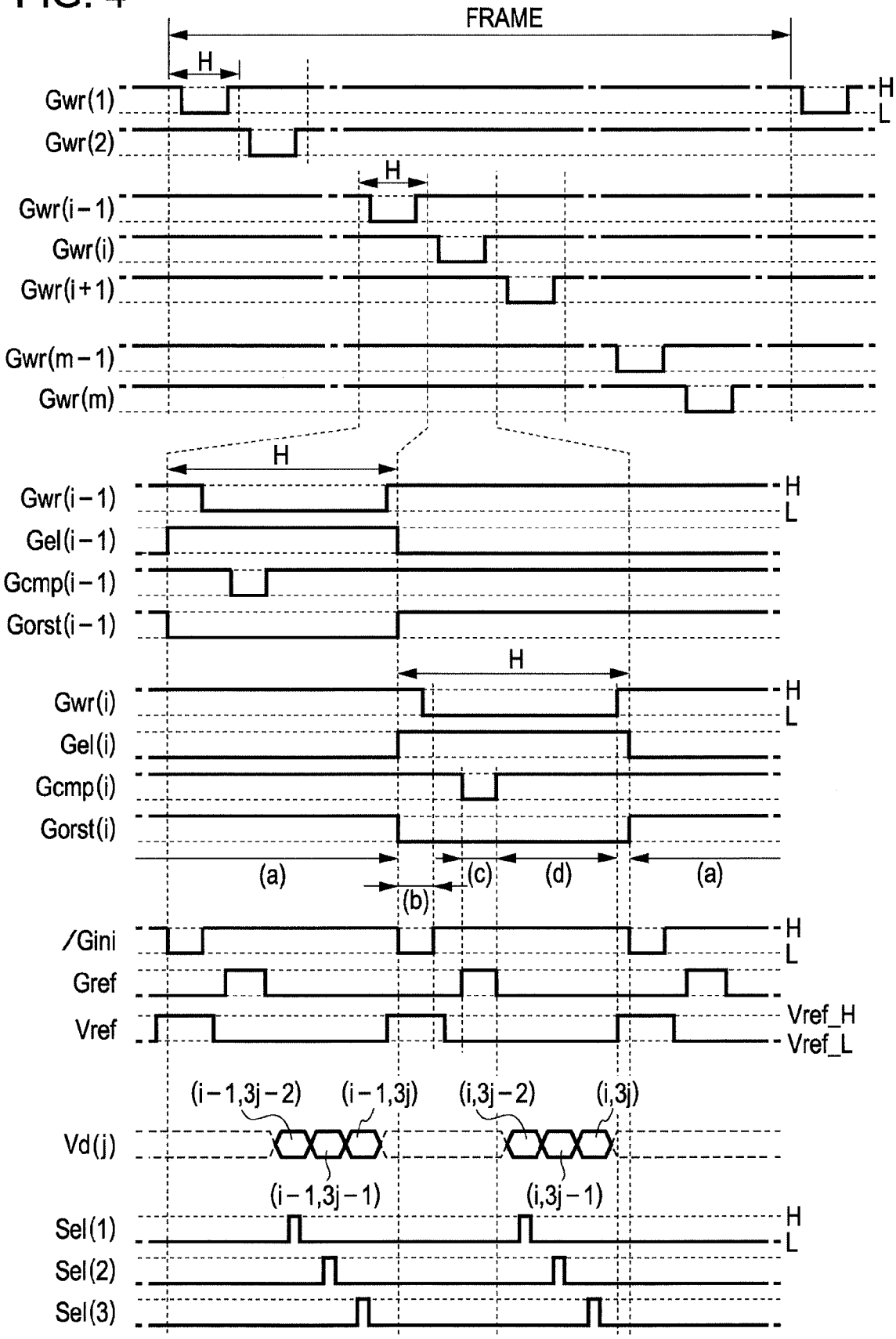
FIG. 4 is a timing chart which shows an operation of the electrooptic device.

An operation of the electrooptic device 10 will be explained with reference to FIG. 4. FIG. 4 is a timing chart for explaining operations of the respective portions of the electrooptic device 10.

As shown in this drawing, the scan line driver circuit 20 changes the scan signals Gwr(1)-Gwr(m) to L level in turn, and scans the scan lines 12 of the first to m-th rows in turn in every period for horizontal scanning (H) over a period of time for one frame.

The operation in one period for horizontal scanning (H) is common to the pixel circuits 110 of the respective rows. Thus, the pixel circuit 110 of the i-th row and (3j−2)-th column is paid attention to and its operation in a period for scanning in which the i-th row is horizontally scanned will be explained below.

The period for scanning the i-th row of the embodiment can be broadly divided into periods of initialization, compensation and writing indicated with symbols (b), (c) and (d), respectively, in FIG. 4. After the period for writing (d), then, a period for light emission indicated with a symbol (a) comes, and the period for scanning the i-th row is reached again after a period of time for one frame passes. Thus, chronologically speaking, a cycle formed by the (period for light emission), period for initialization, period for compensation, period for writing and (period for light emission) in this order is repeated.

Incidentally, in FIG. 4, the scan signal Gwr(i−1) and the control signals Gel(i−1), Gcmp(i−1) and Gorst(i−1) corresponding to the (i−1)-th row, one row ahead of the i-th row, have waveforms temporally preceding those of the scan signal Gwr(i) and the control signals Gel(i), Gcmp(i) and Gorst (i) corresponding to the i-th row, respectively, by one period for horizontal scanning (H).

Period for Light Emission

The period for light emission to be preconditions of the period for initialization will be explained first for convenience of explanation. As shown in FIG. 4, the scan line driver circuit 20 sets the scan signal Gwr(i) to H level, the control signal Gel(i) to L level, the control signal Gcmp(i) to H level and the control signal Gorst(i) to H level in the period for light emission of the i-th row.

Figure 5:
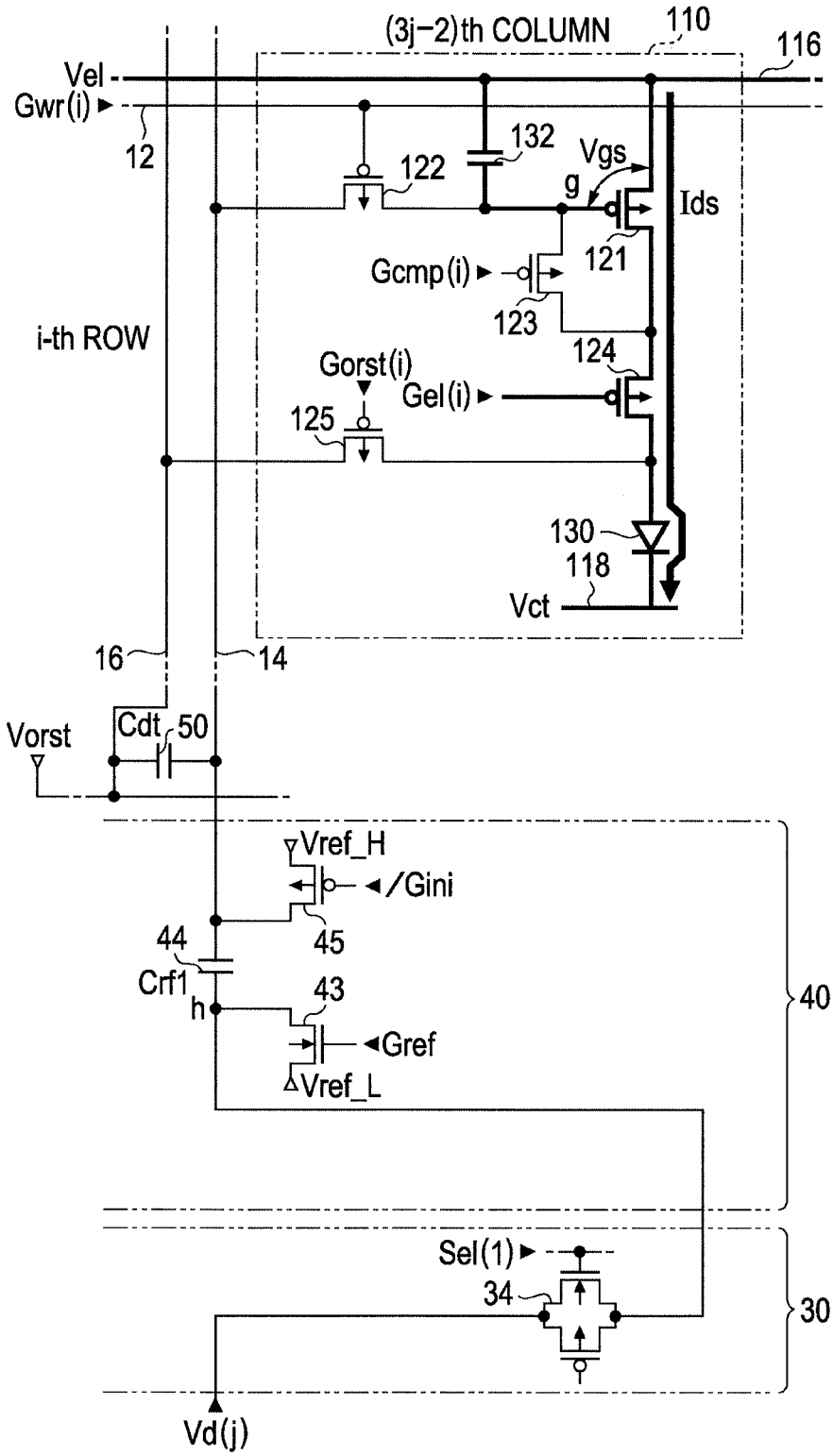
FIG. 5 illustrates an operation of the electrooptic device.

Thus, as shown in FIG. 5, while the transistor 124 is turned on, the transistors 122, 123 and 125 are turned off in the pixel circuit 110 of the i-th row and (3j−2)-th column. The transistor 121 thereby provides the OLED 130 with a current Ids according to a gate-source voltage Vgs. The voltage Vgs in the period for light emission is of a level shifted from a threshold voltage of the transistor 121 according to a voltage of a data signal as described later. Thus, the OLED 130 is provided with a current according to a gradation level in condition that the threshold voltage of the transistor 121 is compensated.

Incidentally, as the rows except for the i-th one are horizontally scanned in the period for light emission of the i-th row, the voltage more or less changes on the data line 14. As the transistor 122 is kept off in the pixel circuit 110 of the i-th row though, the change in the voltage on the data line 14 is not taken into account here.

Further, in FIG. 5, a path to be important for explanation of operations is indicated with a bold line (similarly as in FIGS. 6-8 and 13-16 shown below).

Period for Initialization

Then, when the period for scanning the i-th row comes, the period for initialization (b) starts as a first period at first. As shown in FIG. 4, while setting the control signal Gel(i) to H level and the control signal Gorst(i) to L level, the scan line driver circuit 20 maintains the control signal Gcmp(i) at H level in the period for initialization.

Figure 6:
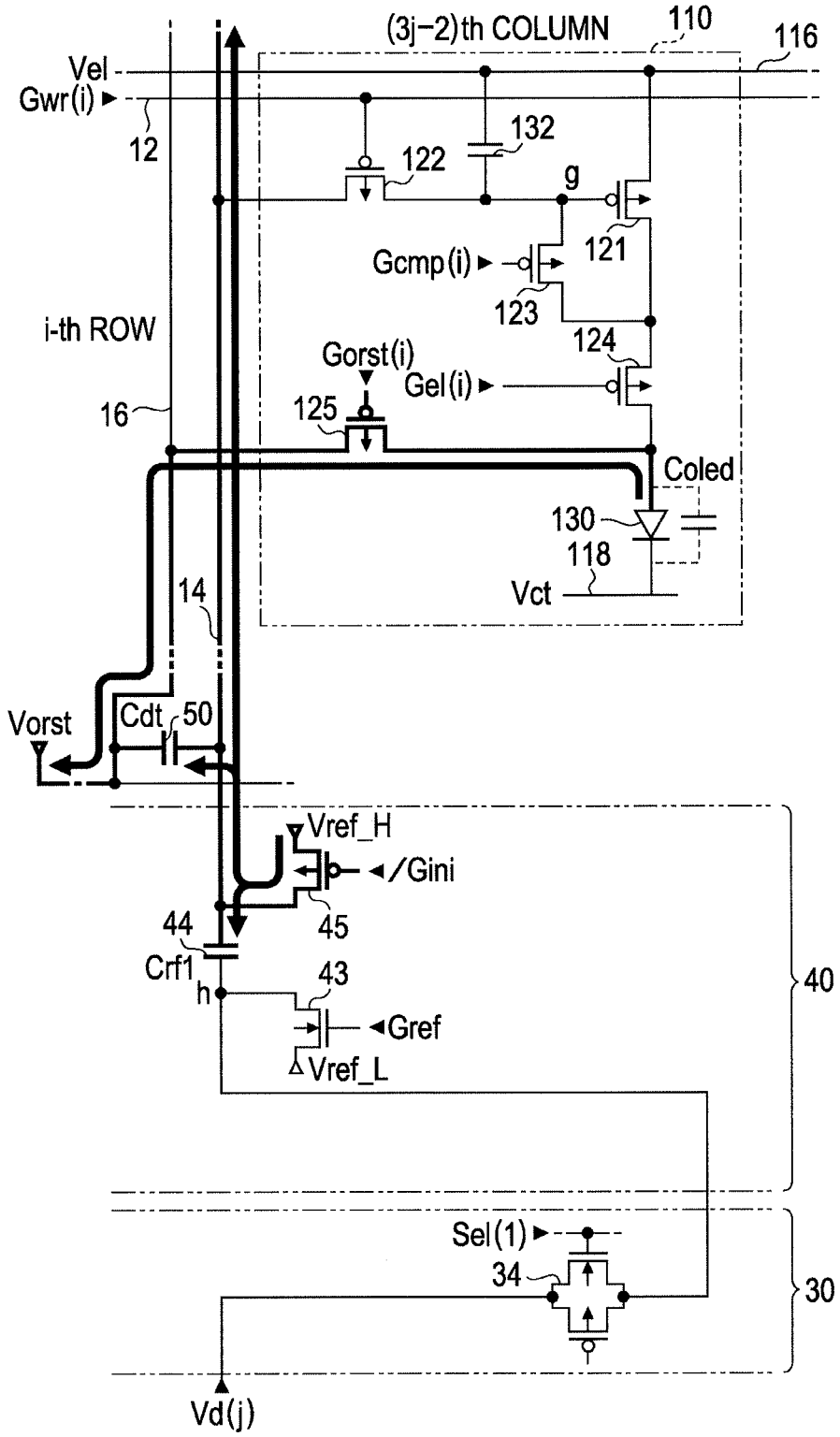
FIG. 6 illustrates an operation of the electrooptic device.

Thus, the transistor 124 is turned off and the transistor 125 is turned on in the pixel circuit 110 of the i-th row and (3j−2)-th column as shown in FIG. 6. A path of the current provided to the OLED 130 is thereby cut off and the anode of the OLED 130 is reset to the voltage Vorst.

As the OLED 130 is formed by the anode and the cathode between which the organic EL layer is held as described above, a capacitor Coled lives on that parallel to and between the anode and the cathode as indicated with a dashed line in the drawing. When a current flows through the OLED 130 in the period for light emission, the voltage between the both anode and cathode ends is held by means of the capacitor Coled, and the held voltage is reset upon the transistor 125 being turned on. When a current flows through the OLED 130 again in a period for light emission later, the embodiment is thereby hardly affected by the voltage held by the capacitor Coled.

For a detailed explanation, e.g., suppose a structure not to be reset upon changing from display condition of high brightness to display condition of low brightness. As a high voltage in time of high brightness (when a large current flows) is held in such a structure, an excessive current flows and display condition of low brightness cannot be achieved in spite of a next attempt at letting a small current flow. Meanwhile, as the voltage is reset on the anode of the OLED 130 upon the transistor 125 being turned on according to the embodiment, reproducibility on the low brightness side can be enhanced.

Incidentally, the voltage Vorst is set, according to the embodiment, in such a way that a difference between the voltage Vorst and the voltage Vct on the common electrode 118 is smaller than a light emission threshold voltage of the OLED 130. Thus, the OLED 130 is in condition of being kept off (not emitting light) in the period for initialization (periods of compensation and writing to be explained next).

In the meantime, while setting the control signals /Gini and Gref to L level, the control circuit 5 provides the feeder line 61 with a voltage Vref_H in the period for initialization as shown in FIG. 4. Thus, while the transistor 45 is in condition of being kept on, the transistor 43 is in condition of being kept off in the level shift circuit 40 as shown in FIG. 6. The one end of the holding capacitor 44 is thereby electrically coupled with the feeder line 61, and the data line 14 which is the one end of the holding capacitor 44 is initialized to the voltage Vref_H.

Incidentally, the scan line driver circuit 20 changes the scan signal Gwr(i) from H level to L level between the start and the end of the period for initialization as shown in FIG. 4. As the transistor 122 is thereby turned on and the gate node g of the transistor 121 is electrically coupled with the data line 14, the gate node g is set to the voltage Vref_H.

According to the embodiment, the voltage Vref_H is set in such a way that (Vel−Vref-H) is greater than the threshold voltage |Vth| of the transistor 121. Incidentally, as the transistor 121 is of a p-channel type, the threshold voltage Vth is negative with respect to the voltage on the source node. Thus, the threshold voltage is indicated with an absolute value |Vth| and is specified according to a greater-smaller relationship in order that an explanation of a higher-lower relationship is prevented from causing confusion.

Incidentally, although the scan line driver 20 of the embodiment changes the scan signal Gwr(i) from H level to L level after the period for initialization of the i-th row starts and before the period for initialization ends, the invention is not limited to such a configuration and the scan line driver 20 may change the scan signal Gwr(i) to L level after the period for initialization starts and before the period for compensation starts. The scan line driver 20 may change the scan signal Gwr(i) from H level to L level, e.g., concurrently with the start of the period for initialization, or may change the scan signal Gwr(i) from H level to L level concurrently with the start of the period for compensation.

Period for Compensation

The period for scanning the i-th row then comes to the period for compensation (c), a second period. As shown in FIG. 4, while setting the control signal /Gini to H level and the control signal Gref to H level, the control circuit 5 provides the feeder line 61 with the voltage Vref_L in the period for compensation.

Figure 7:
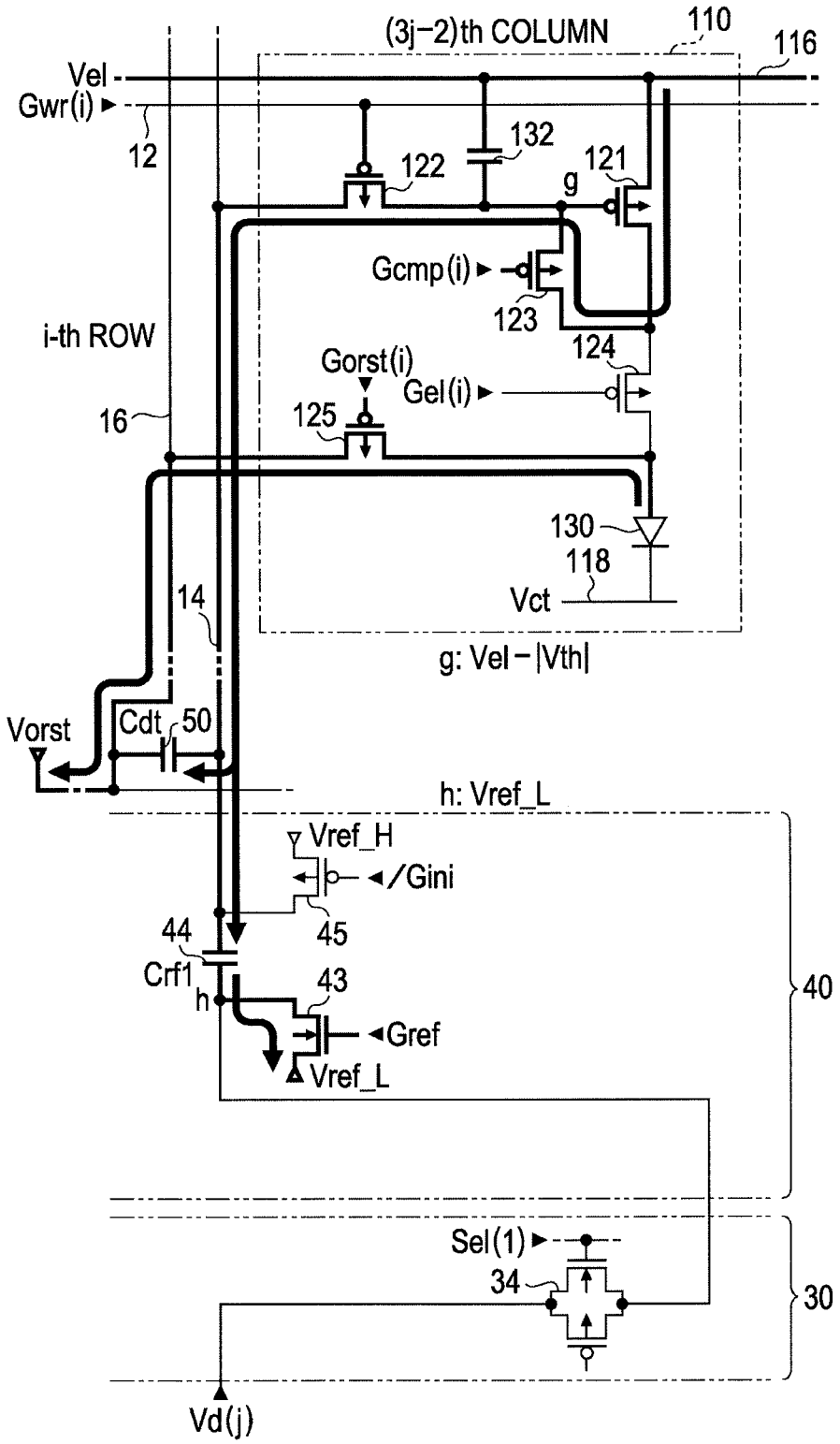
FIG. 7 illustrates an operation of the electrooptic device.

Thus, while the transistor 43 is in condition of being kept on, the transistor 45 is in condition of being kept off in the level shift circuit 40 as shown in FIG. 7. The other end of the holding capacitor 44 is thereby electrically coupled with the feeder line 61 and the node h is set to the voltage Vref_L.

Incidentally, the voltage Vref_L is set to a value such that the voltage on the node h changes upwards with respect to voltages which the data signals Vd(1)-Vd(n) can be given afterwards in the period for writing, e.g., lower than the lowest value Vmin according to the embodiment.

Further, while setting the control signal Gcmp(i) to L level, the scan line driver circuit 20 maintains the scan signal Gwr(i) and the control signals Gel(i) and Gorst(i) at L level, H level and L level, respectively, in the period for compensation as shown in FIG. 4.

As the transistor 123 is thereby turned on as shown in FIG. 7, the transistor 121 is in diode connection. A drain current thereby flows through the transistor 121 and charges the gate node g and the data line 14. Speaking in detail, the current flows through a path formed by the data line 116, the transistor 121, the transistor 123, the transistor 122 and the data line 14 of the (3j−2)-th column in this order. Thus, the data line 14 and the gate node g being coupled with each other as the transistor 121 is kept on rise from the voltage Vref_H.

As it grows harder to let the current continue to flow through the above path as the gate node g comes closer to a voltage (Vel−|Vth|) though, the data line 14 and the gate node g are saturated on the voltage (Vel−|Vth|) before the end of the period for compensation comes. Thus, the holding capacitor 132 resultantly holds the threshold voltage |Vth| of the transistor 121 until the end of the period for compensation.

Period for Writing

The period for writing (d), a third period, comes after the period for initialization. While maintaining the scan signal Gwr(i) and the control signals Gel(i) and Gorst(i) at L, H and L level, respectively, the scan line driver circuit 20 sets the control signal Gcmp(i) to H level in the period for writing as shown in FIG. 4. Thus, the transistor 121 is released from the diode connection.

Further, as the control circuit 5 sets the control signals /Gini and Gref to H and L level, respectively, as shown in FIG. 4, the transistor 45 maintains condition of being kept off and the transistor 43 is in condition of being kept off as well.

Thus, although the path from the data line 14 of the (3j−2)-th column to the gate node g in the pixel circuit 110 of the i-th row and the (3j−2)-th column is in floating condition, the voltage (Vel−|Vth|) is maintained on the path by the holding capacitors 50 and 132.

In the period for writing on the i-th row, the control circuit 5 changes the data signal of, e.g., the j-th group Vd(j) to voltages according to gradation levels of pixels of the i-th row and (3j−2)-th column, the i-th row and (3j−1)-th column and the i-th row and (3j)-th column in turn. In the meantime, the control circuit 5 sets the control signals Sel(1), Sel(2) and Sel(3) exclusively to H level in turn as synchronized with the changes of the data signal voltages. The control circuit 5 produces outputs, although omitted to be shown in FIG. 4, as to the control signals /Sel(1), /Sel(2) and /Sel(3) into which the control signals Sel(1), Sel(2) and Sel(3) are logically inverted, respectively. In each of the groups in the demultiplexer 30, the transmissions gates 34 are thereby turned on in order of the left end, middle and right end columns.

Figure 8:
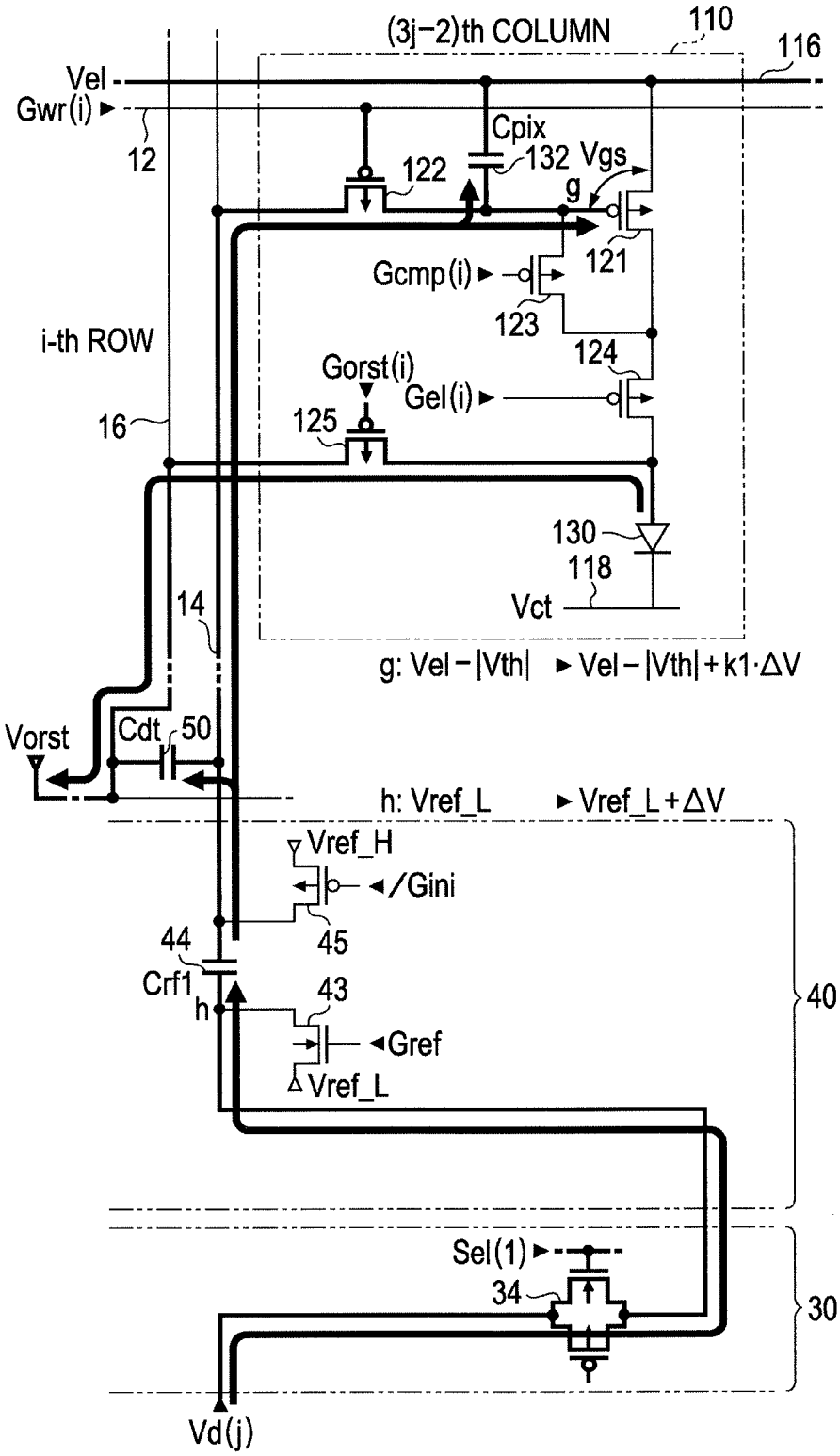
FIG. 8 illustrates an operation of the electrooptic device.

When the transmission gate 34 on the left end column is turned on by the control signals Sel(1) and /Sel(1), the node h which is the other end of the holding capacitor 44 changes from the voltage Vref_L set in the period for compensation to the voltage of the data signal Vd(j), i.e., the voltage according to the gradation level of the pixel of the i-th row and (3j−2)-th column as shown in FIG. 8. Let a voltage change on the node h be ΔV, and the voltage after the change is written as (Vref−L+ΔV).

Meanwhile, as being coupled with the one end of the holding capacitor 44 via the data line 14, the gate node g changes the voltage from the value (Vel−|Vth|) given in the period for compensation to a value (Vel−|Vth|+k1·ΔV) shifted upwards by the voltage change ΔV on the node h multiplied by a capacitance ratio k1. The voltage Vgs on the transistor 121 is expressed in an absolute value at this time as a value (Ϥ Vth|−k1·ΔV) which is the magnitude of the upward shift on the gate node g subtracted from the threshold voltage |Vth|.

Incidentally, the capacitance ratio k1 is Crf1/(Cdt+Crf1). The capacitance value Cpix of the holding capacitor 132 has to be taken into account, strictly speaking, but is neglected in practice as having been set significantly smaller than the capacitance values Crf1 and Cdt.

Figure 9:
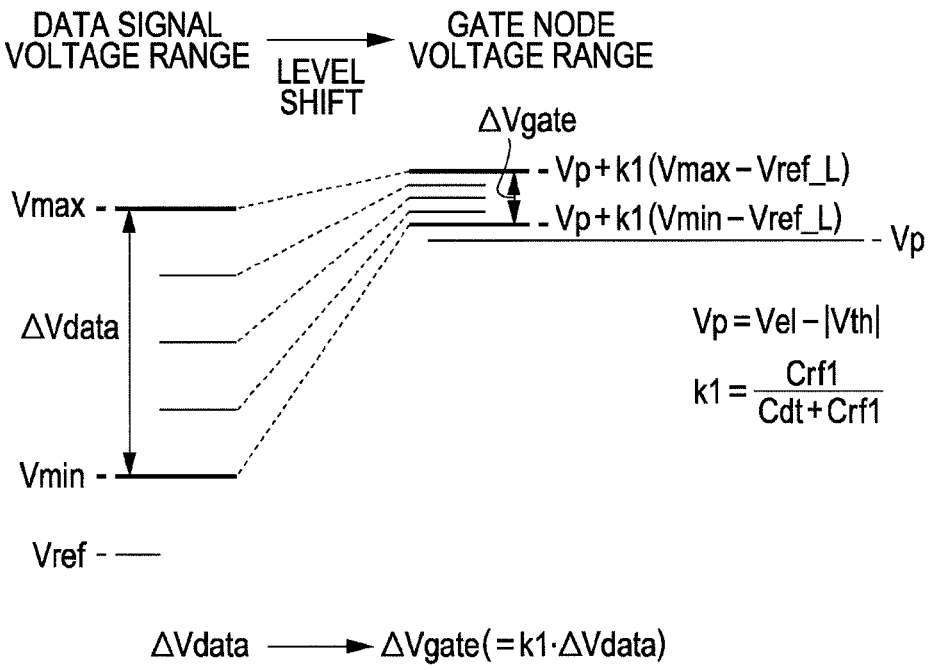
FIG. 9 shows amplitude compression of a data signal in the electrooptic device.

FIG. 9 shows a relationship between the data signal voltage and the voltage on the gate node g in the period for writing. The data signal provided by the control circuit 5 can be given a voltage within a range between the lowest Vmin and the highest Vmax according to the gradation levels of the pixels as described above. According to the embodiment, the data signal is not written directly into the gate node g but is written into the gate node g after a shift in the voltage as shown in the drawing.

The voltage range on the gate node g, ΔVgate, is compressed into the voltage range of the data signal, ΔVdata (=Vmax−Vmin) multiplied by the capacitance ratio k1 at this time. If capacitance values of the holding capacitors 44 and 50 are set in such a way as Crf1/Cdt=1/9, e.g., the voltage range ΔVgate on the gate node g can be compressed into one tenth of the voltage range ΔVdata of the data signal.

Further, in which direction and to what extent the voltage range ΔVgate on the gate node g is shifted with respect to the voltage range ΔVdata of the data signal can be specified depending upon the voltages Vp(=Vel−|Vth|) and Vref_L. That is because the voltage range ΔVdata of the data signal is compressed with respect to the voltage Vref_L by the capacitance ratio k1 and the compressed range is shifted with respect to the voltage Vp to be the voltage range ΔVgate on the gate node g.

In the period for writing on the i-th row, in this way, the voltage (Vel−|Vth|+k1·ΔV) that the voltage (Vel−|Vth|) in the period for compensation is shifted to by the voltage change ΔV on the node h multiplied by the capacitance ratio k1 is written into the gate node g in the pixel circuit 110 of the i-th row.

Period for Light Emission

The period for light emission starts after the period for writing on the i-th row ends.

As the scan line driver circuit 20 sets the scan signal Gwr(i) to H level in the period for light emission as described above, the transistor 122 is turned off. The voltage on the gate node g is thereby maintained at the voltage (Vel−|Vth|+k1·ΔV) after the shift. Further, as the scan line driver circuit 20 sets the control signal Gel(i) to L level in the period for light emission as described above, the transistor 124 is turned on in the pixel circuit 110 of the i-th row and (3j−2)-th column. As the gate-source voltage Vgs is (|Vth|−k1·ΔV), the OLED 130 is provided with a current according to the gradation level in condition that the threshold voltage of the transistor 121 is compensated as previously shown in FIG. 5.

The other pixel circuits 110 on the i-th row except for the pixel circuit 110 on the (3j−2)-th column simultaneously carry out the above operation in the period for scanning the i-th row. Further, the above operation on the i-th row is practically carried out in order of the first, second, third through (m−1)-th and m-th rows in a period for one frame and is repeated on a frame-by-frame basis.

As the voltage range ΔVgate on the gate node g can be narrowed down as compared with the voltage range ΔVdata of the data signal according to the embodiment, a voltage on which the gradation level is reflected can be applied to and between the gate and the source of the transistor 121 even if the data signal is not marked with fine degrees. Even if a minute current relatively significantly changes with respect to the change in the gate-source voltage Vgs of the transistor 121 in the pixel circuit 110, the current to be provided to the OLED 130 can thereby be precisely controlled.

Further, a capacitor Cprs may live on and between the data line 14 and the gate node g in the pixel circuit 110 as shown by dashed lines in FIG. 3 in some cases. Upon being significant in this case, the width of the voltage change is propagated to the gate node g via the capacitor Cprs, resulting in that so called crosstalk or unevenness is caused and the display quality is degraded. The effect of the capacitor Cprs clearly appears when the pixel circuit 110 is finely structured.

Meanwhile, as the range of the voltage change on the data line 14 can be narrowed down as compared with the voltage range ΔVdata of the data signal according to the embodiment, the effect caused via the capacitor Cprs can be suppressed.

Further, while providing the feeder line 61 with the voltage Vref_H so as to turn the transistor 45 on in the period for initialization, the control circuit 5 provides the feeder line 61 with the voltage Vref_L so as to turn the transistor 43 on in the period for compensation according to the embodiment. Thus, the supply of the voltage Vref_H to the one end of the holding capacitor 44 and the supply of the voltage Vref_L to the other end of the holding capacitor 44 can be achieved in the period for initialization and in the period for compensation, respectively, by means of the one data line 61.

The electrooptic device 10 can thereby be downsized and simplified as compared with a case where feeder lines which provide the one end and the other end of the holding capacitor 44 with the voltages Vref_H and Vref_L, respectively, are provided separately.

Further, an effect of the threshold voltage on a current Ids provided to the OLED 130 by the transistor 121 is canceled according to the embodiment. Thus, even if the threshold voltage of the transistor 121 varies in every one of the pixel circuits 110, the variation is compensated and the OLED 130 is provided with a current according to the gradation level according to the embodiment. Thus, display unevenness to degrade uniformity on a displayed screen is prevented from occurring and display of a high quality is resultantly enabled.

Figure 10:
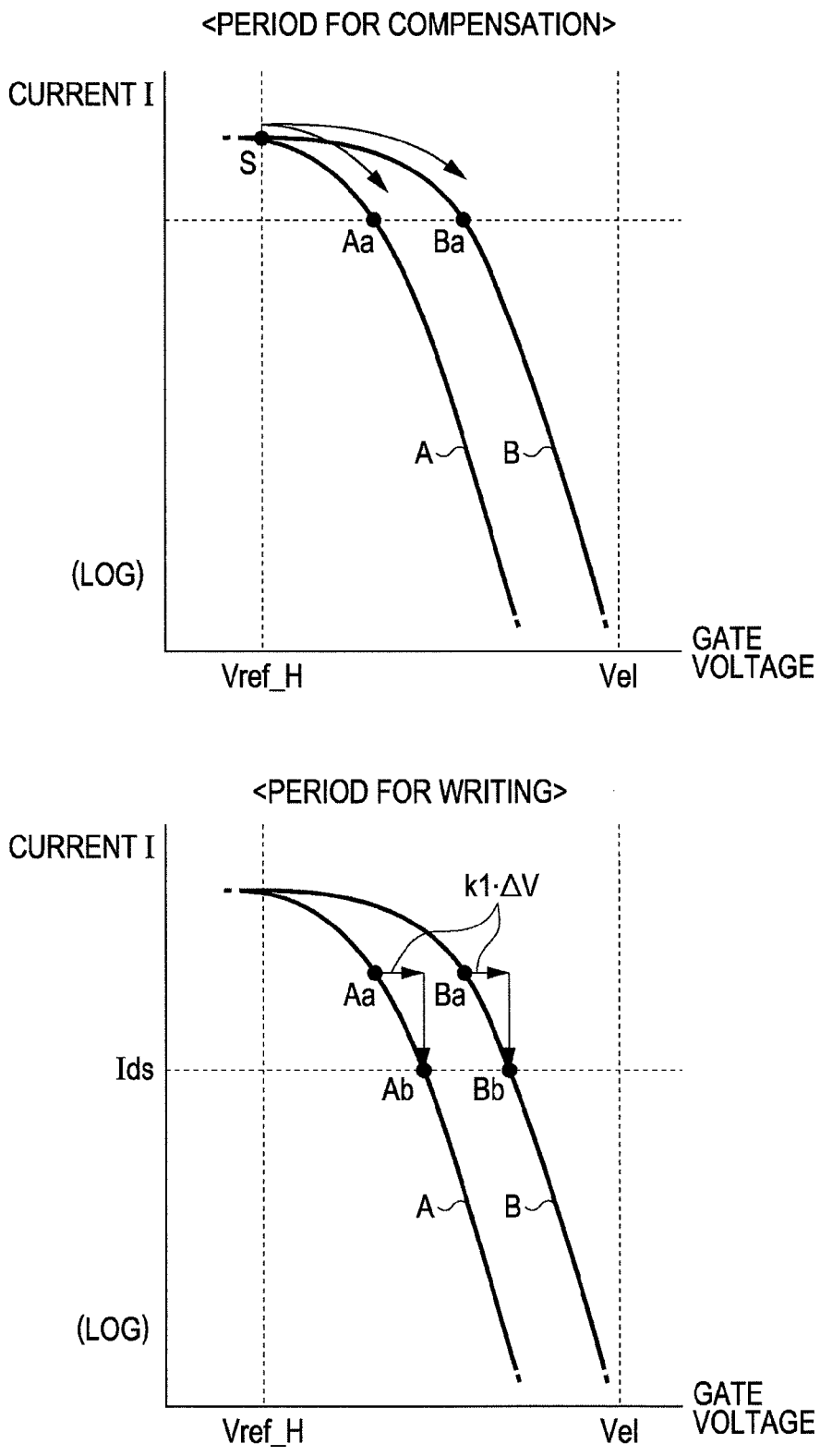
FIG. 10 shows characteristics of transistors in the electrooptic device.

The above cancellation will be explained with reference to FIG. 10. As shown in the drawing, the transistor 121 operates in a weakly inverted region (sub-threshold region) so as to control the minute current to be provided to the OLED 130.

In the drawing, symbols A and B indicate transistors of a large threshold voltage |Vth| and of a small threshold voltage |Vth|, respectively. Incidentally, the gate-source voltage Vgs is a difference between the characteristic indicated by the solid line and the voltage Vel in FIG. 10. Further, the current is indicated in a logarithmic scale in which the direction from the source to the drain is negative (downwards) on the vertical axis in FIG. 10.

The gate node g shifts from the voltage Vref_H to the voltage (Vel−|Vth|) in the period for compensation. Thus, while an operating point of a transistor A having a large threshold voltage |Vth| moves from S to Aa, an operating point of a transistor B having a small threshold voltage |Vth| moves from S to Ba.

Then, if data signals coming to the pixel circuit 110 that the two transistors belong to are of a same voltage, i.e., if a same gradation level is specified, voltage shifts from the operating points Aa and Ba are both k1·ΔV, equal to each other in the period for writing. Thus, while the operating points of the transistors A and B move from Aa to Ab and from Ba to Bb, respectively, currents on operating points of the transistors A and B after the voltage shifts are both Ids, substantially equal to each other.

Second Embodiment

The first embodiment is structured in such a way that the other end of the holding capacitor 44 of each of the columns, i.e., the node h is directly provided with a data signal by the demultiplexer 30. Thus, as the period of time in which a data signal is provided by the control circuit 5 equals the period for writing in the period for scanning each of the rows, temporal limitation is significant.

Thus, a second embodiment which can alleviate such temporal limitation will be explained next. Incidentally, portions different from corresponding ones of the first embodiment will be mainly explained below in order that a repeated explanation is avoided.

Figure 11:
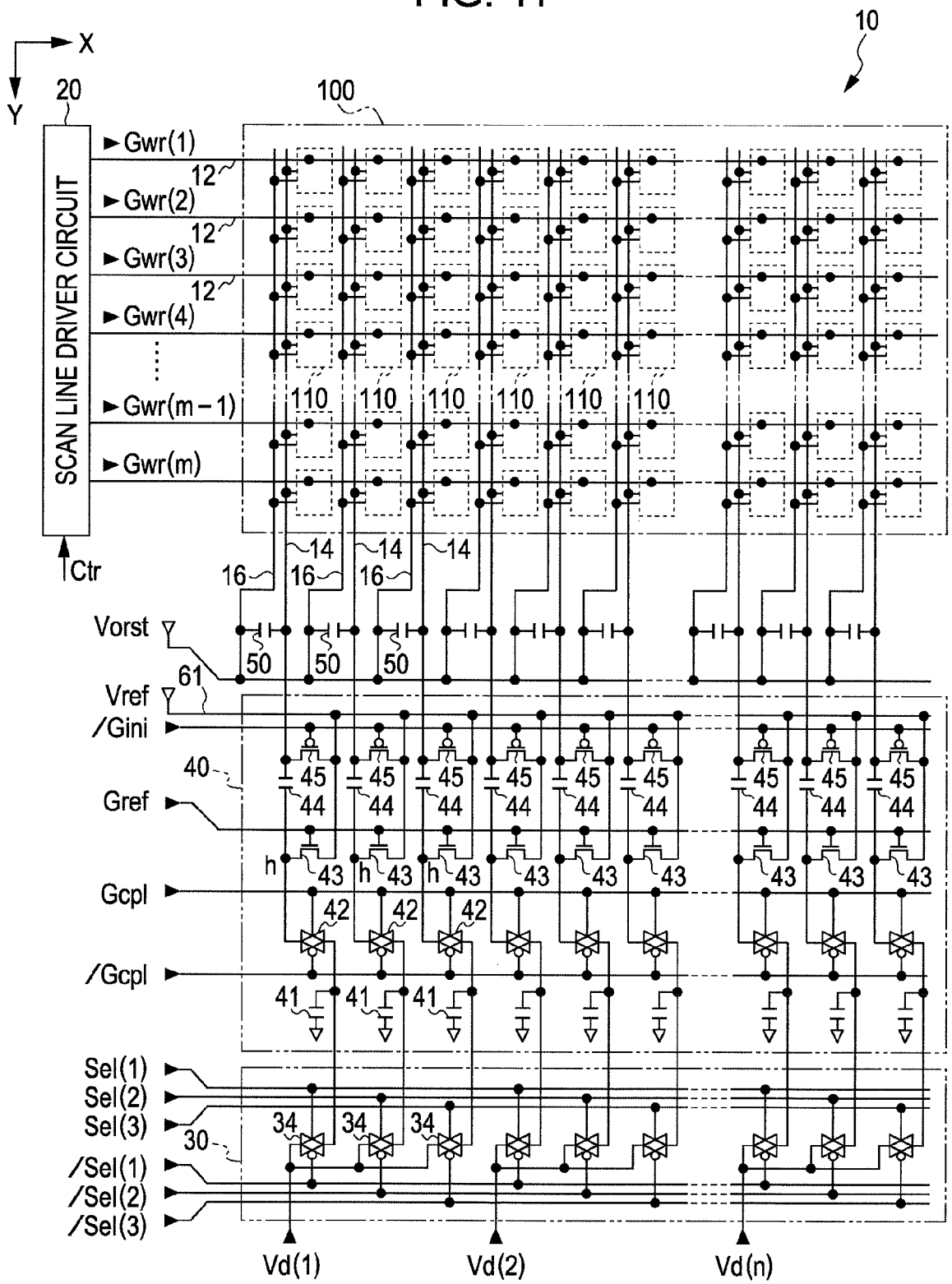
FIG. 11 shows a structure of an electrooptic device of a second embodiment.

FIG. 11 illustrates a structure of an electrooptic device 10 of a second embodiment.

The second embodiment shown in the drawing is different from the first embodiment shown in FIG. 2 mainly in that the columns in the level shift circuit 40 are each provided with a holding capacitor 41 (fourth holding capacitor) and a transmission gate 42 (first switch).

Speaking in detail, the transmission gate 42 is put electrically between the output end of the transmission gate 34 and the other end of the holding capacitor 44 on each of the columns. That is, an input end of the transmission gate 42 is coupled with the output end of the transmission gate 34, and an output end of the transmission gate 42 is coupled with the other end of the holding capacitor 44.

Incidentally, the transmission gates 42 on the respective columns are turned on at the same time when the control signal Gcp1 provided by the control circuit 5 is at H level (when the control signal /Gcp1 is at L level).

Further, the one end of the holding capacitor 41 is coupled with the output end of the transmission gate 34 (input end of the transmission gate 42) and the other end of the holding capacitor 41 is grounded to fixed voltage, e.g., Vss in common on each of the columns. Let the capacitance value of the holding capacitor 41 be Crf2, although omitted in FIG. 11. Incidentally, the voltage Vss corresponds to the L level of scan or control signals which are digital signals.

Operation of Second Embodiment

Figure 12:
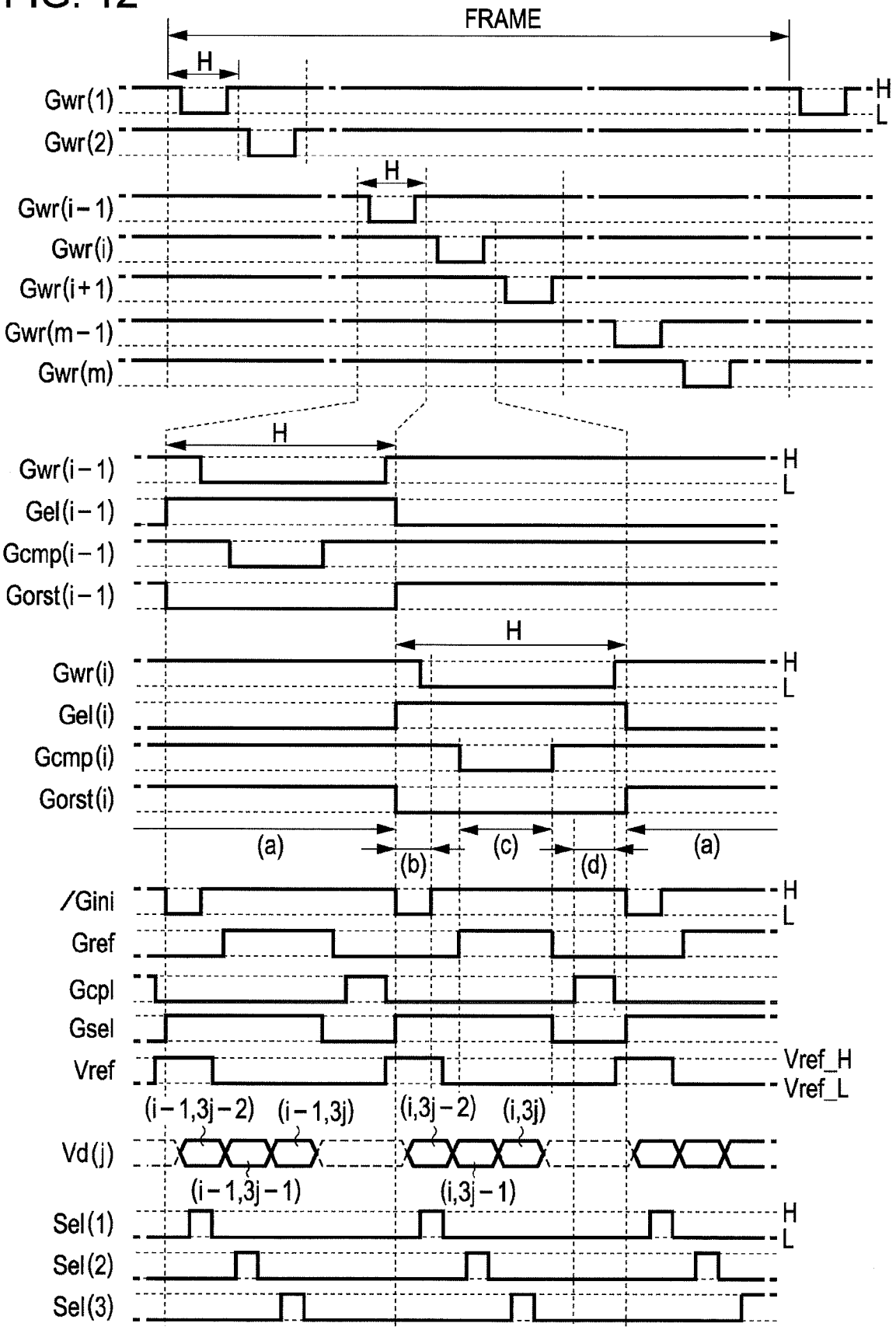
FIG. 12 is a timing chart which shows an operation of the electrooptic device.

An operation of the electrooptic device 10 of the second embodiment will be explained with reference to FIG. 12. FIG. 12 is a timing chart for explaining an operation of the second embodiment.

As shown in the drawing, the second embodiment works in the same way as the first embodiment in that the scan signals Gwr(1)-Gwr(m) are changed to L level in turn and the scan lines 12 of the first to m-th rows are scanned in turn over a period of time for one frame in every period for horizontal scanning (H). Further, the second embodiment works in the same way as the first embodiment as well in that the period for scanning the i-th row is formed by the periods of initialization, compensation and writing indicated with (b), (c) and (d), respectively, in this order. Incidentally, the period for writing (d) is a period of time since the control signal Gcp1 changes from L to H level (the control signal /Gcp1 changes to L level) until the scan signal changes from L to H level as regards the second embodiment.

Chronologically speaking as regards the second embodiment, a cycle formed by the (period for light emission), period for initialization, period for compensation, period for writing and (period for light emission) in this order is repeated in the same way as the first embodiment. The second embodiment is different as compared with the first embodiment, though, in that a period of time in which the data signal is provided does not equal the period for writing and that the supply of data signal precedes the period for writing. Speaking in detail, the second embodiment is different from the first embodiment in that the data signal can be provided over the period for initialization (a) and the period for compensation (b).

Period for Light Emission

As shown in FIG. 12, the scan line driver circuit 20 sets the scan line signal Gwr(i) to H level, the control signal Gel(i) to L level, the control signal Gcmp(i) to H level and the control signal Gorst(i) to H level in the period for light emission of the i-th row.

Figure 13:
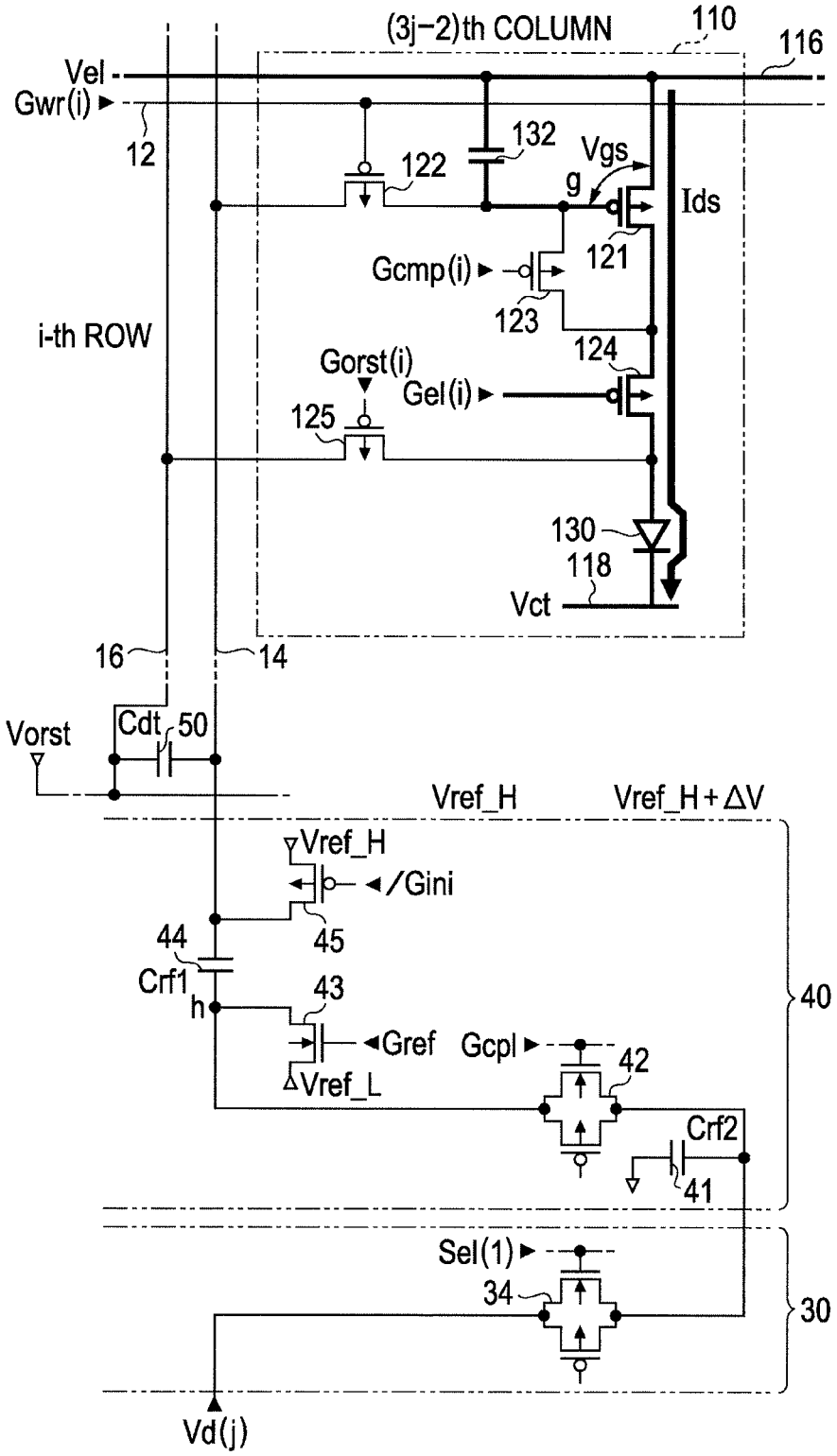
FIG. 13 illustrates an operation of the electrooptic device.

Thus, as shown in FIG. 13, while the transistor 124 is turned on, the transistors 122, 123 and 125 are turned off in the pixel circuit 110 of the i-th row and (3j−2)-th column. Thus, the relevant pixel circuit 110 operates primarily in the same way as the first embodiment. That is, the transistor 121 provides the OLED 130 with a current Ids according to the gate-source voltage Vgs.

Period for Initialization

When the period for scanning the i-th row comes, the period for initialization (b) starts at first. As shown in FIG. 12, while setting the control signal Gel(i) to H level and the control signal Gorst(i) to L level, the scan line driver circuit 20 maintains the control signal Gcmp(i) at H level in the period for initialization.

Figure 14:
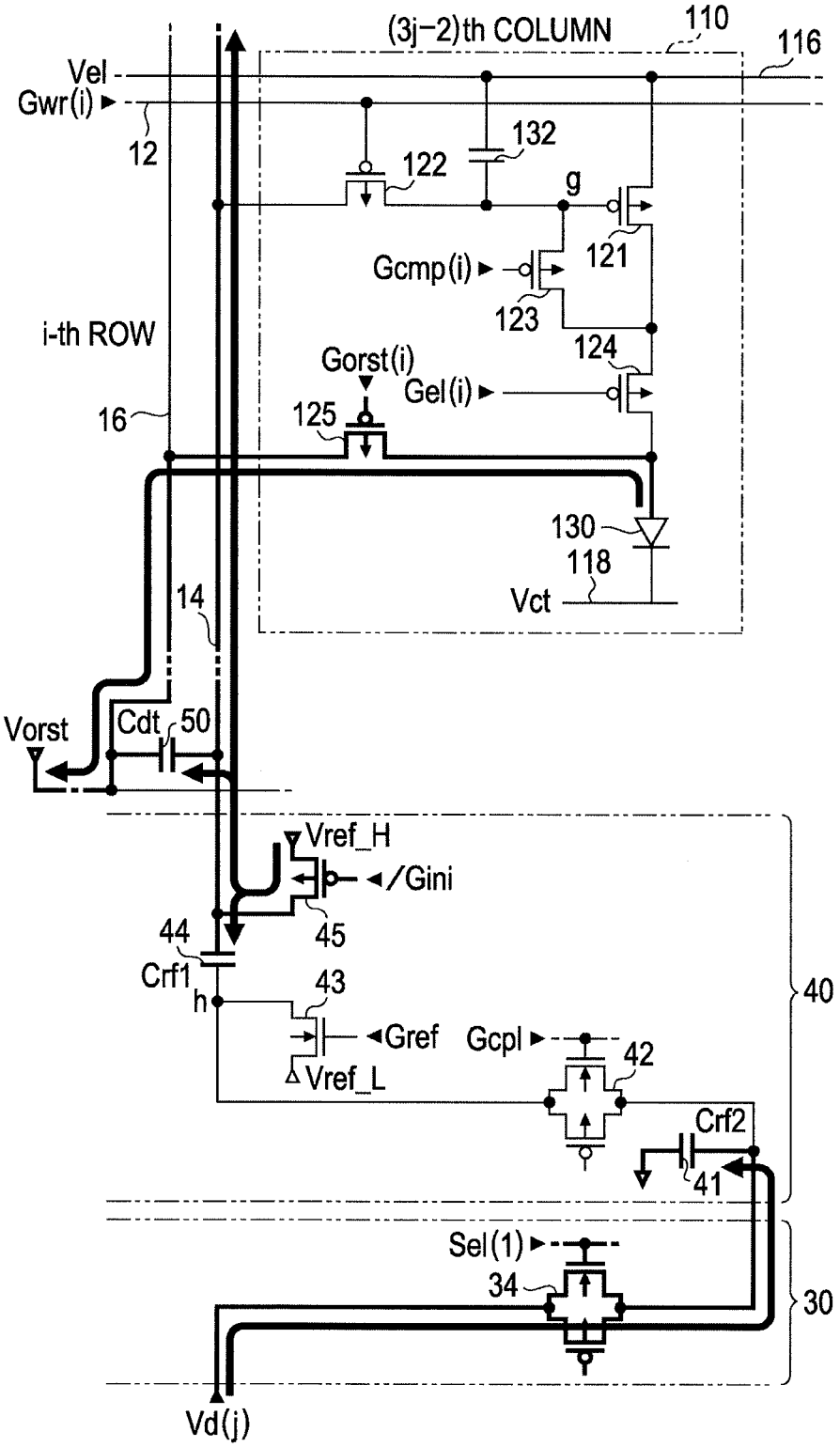
FIG. 14 illustrates an operation of the electrooptic device.

Thus, the transistor 124 is turned off and the transistor 125 is turned on in the pixel circuit 110 of the i-th row and (3j−2)-th column as shown in FIG. 14. As path of the current provided to the OLED 130 is thereby cut off and the anode of the OLED 130 is reset to the voltage Vorst as the transistor 124 is turned on, the relevant pixel circuit 110 operates primarily in the same way as the first embodiment.

In the meantime, while setting the control signals /Gini and Gref to L level, the control circuit 5 provides the feeder line 61 with the voltage Vref_H in the period for initialization as shown in FIG. 12.

Thus, as shown in FIG. 14, while the transistor 45 is in condition of being kept on, the transistor 43 is in condition of being kept off. The one end of the holding capacitor 44 is thereby electrically coupled with the feeder line 61 and the data line 14 which is the one end of the holding capacitor 44 is initialized to the voltage Vref_H.

Further, the scan line driver circuit 20 changes the scan signal Gwr(i) from H level to L level between the start and the end of the period for initialization (or between the start of the period for initialization and the start of the period for compensation). As the transistor 122 is thereby turned on and the gate node g of the transistor 121 is electrically coupled with the data line 14, the gate node g is set to the voltage Vref_H.

Incidentally, the voltage Vref_H is set in such a way that (Vel−Vref_H) is greater than the threshold voltage |Vth| of the transistor 121, according to the second embodiment as well.

The control circuit 5 of the second embodiment provides the data signal over the period for initialization and the period for compensation as described above. That is, while changing the data signal of, e.g., the j-th group Vd(j) to voltages according to gradation levels of pixels of the i-th row and (3j−2)-th column, the i-th row and (3j−1)-th column and the i-th row and (3j)-th column in turn, the control circuit 5 sets the control signals Sel(1), Sel(2) and Sel(3) exclusively to H level in turn as synchronized with the changes of the data signal voltages. In each of the groups in the demultiplexer 30, the transmissions gates 34 are thereby turned on in order of the left end, middle and right end columns.

If the transmission gate 34 on the left end column belonging to the j-th group is turned on by the control signal Sel(1) in the period for initialization here, the data signal Vd(j) is provided to the one end of the holding capacitor 41 and is thereby held by the holding capacitor 41 as shown in FIG. 14.

Period for Compensation

The period for scanning the i-th row then comes to the period for compensation (c). While setting the control signal Gcmp(i) to L level, the scan line driver circuit 20 maintains the scan signal Gwr(1) and the control signals Gel(i) and Gorst(i) at L level, H level and L level, respectively, in the period for compensation as shown in FIG. 12.

Figure 15:
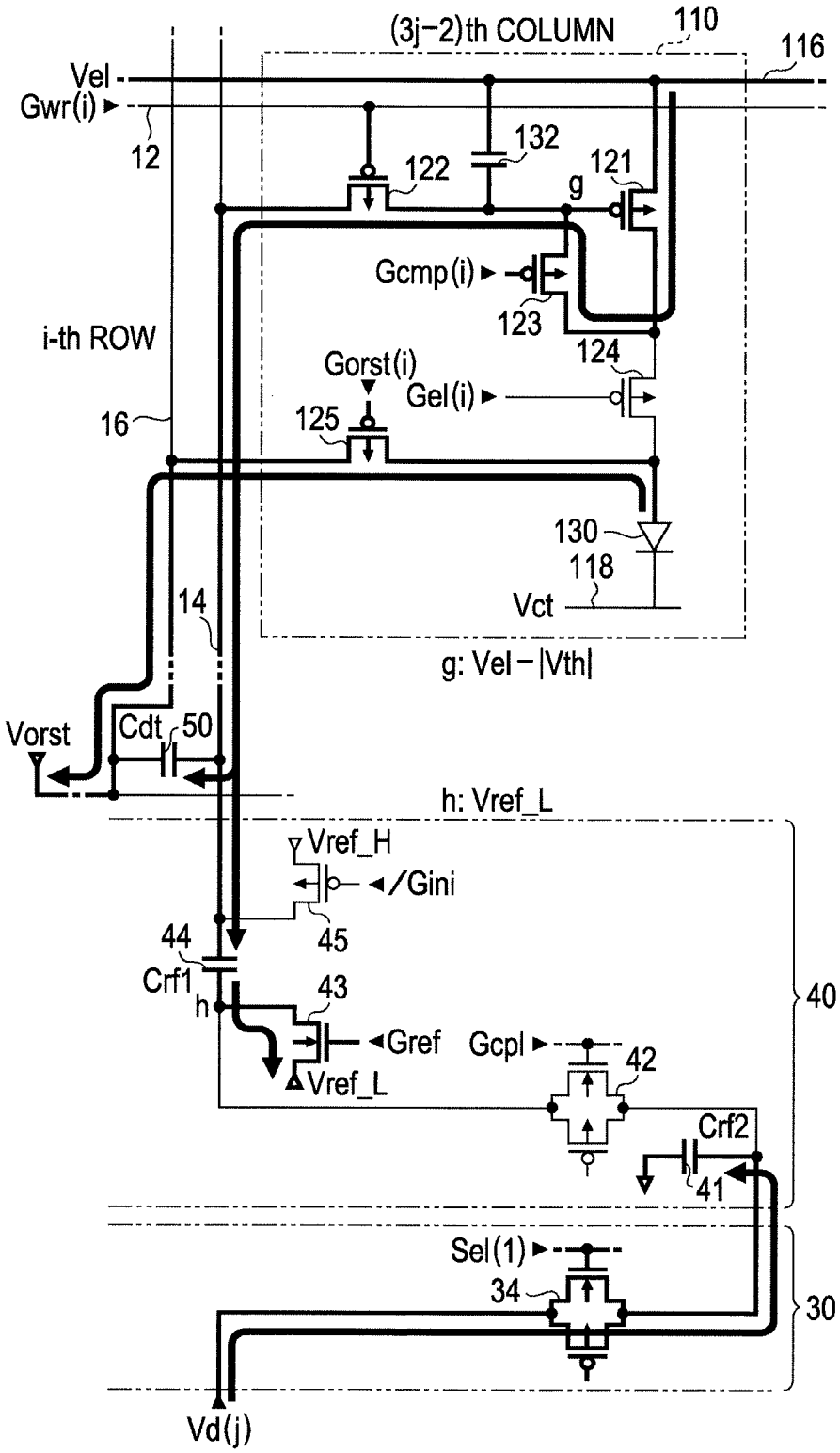
FIG. 15 illustrates an operation of the electrooptic device.

Thus, while the transistor 122 is turned on and the gate node g is electrically coupled with the data line 14 in the pixel circuit 110 of the i-th row and (3j−2)-th column, the transistor 123 is turned on and the transistor 121 is thereby in diode connection as shown in FIG. 15.

Thus, as a current flows through a path formed by the data line 116, the transistor 121, the transistor 123, the transistor 122 and the data line 14 of the (3j−2)-th column in this order, the gate node g rises from the voltage Vref_H, and then is saturated at the voltage (Vel−|Vth|). Thus, the holding capacitor 132 resultantly holds the threshold voltage |Vth| of the transistor 121 until the end of the period for compensation, according to the second embodiment as well.

Further, while setting the control signals /Gini and Gref to H level, the control circuit 5 provides the feeder line 61 with the voltage Vref_L in the period for compensation as shown in FIG. 12.

Thus, while the transistor 43 is in condition of being kept on, the transistor 45 is in condition of being kept off in the level shift circuit 40 as shown in FIG. 15. The other end of the holding capacitor 44 is thereby electrically coupled with the feeder line 61, and the node h is set to the voltage Vref_L.

Incidentally, the voltage Vref_L is set to a value such that the voltage on the node h changes upwards with respect to voltages which the data signals Vd(1)-Vd(n) can be given afterwards in the period for writing, e.g., lower than the lowest value Vmin, according to the second embodiment as well.

Further, if the transmission gate 34 on the left end column belonging to the j-th group is turned on by the control signal Sel(1) in the period for compensation, the data signal Vd(j) is held by the holding capacitor 41 as shown in FIG. 15.

Incidentally, if the transmission gate 34 on the left end column belonging to the j-th group has been turned on by the control signal Sel(1) in the period for initialization, the data signal Vd(j) is held by the holding capacitor 41 without a change although the relevant transmission gate 34 is not turned on in the period for compensation.

As the scan line driver circuit 20 changes the control signal Gcmp(i) from L level to H level after the period for compensation ends, the transistor 121 is released from the diode connection.

Further, as the control circuit 5 changes the control signal Gref from H level to L level after the period for compensation ends, the transistor 43 is turned off. Thus, although the path from the data line 14 of the (3j−2)-th column to the gate node g in the pixel circuit 110 of the i-th row and (3j−2)-th column is in floating condition, the voltage (Vel−|Vth|) is maintained on the path by the holding capacitors 50 and 132.

Incidentally, although changing the control signal Gref from H level to L level when the period for compensation ends according to the embodiment, the control circuit 5 may change the control signal Gref to L level after the period for compensation ends and before the period for writing starts next.

Period for Writing

The period for scanning the i-th row then comes to the period for writing (d). The control circuit 5 sets the control signals /Gini and Gref to H level and L level, respectively, and sets the control signal Gcp1 to H level (sets the control signal /Gcp1 to L level) in the period for writing as shown in FIG. 12.

Figure 16:
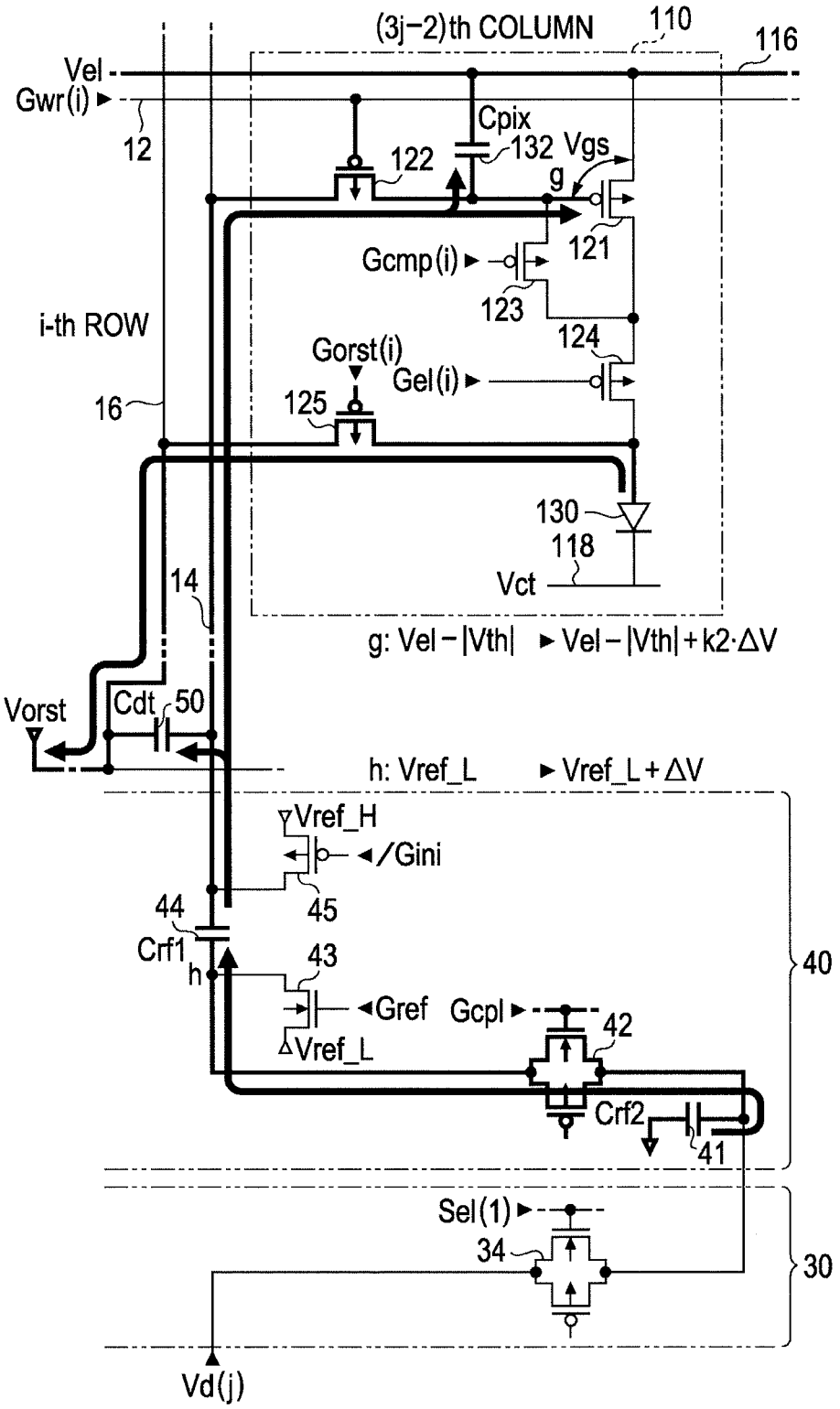
FIG. 16 illustrates an operation of the electrooptic device.

Thus, as the transmission gate 42 is turned on in the level shift circuit 40, the data signal held by the holding capacitor 41 is provided to the other end of the holding capacitor 44, the node h, as shown in FIG. 16. Thus, the node h shifts from the voltage Vref_L in the period for compensation. That is, the node h changes to a voltage (Vref_L+ΔV).

Further, while maintaining the scan signal Gwr(i) and the control signals Gel(i) and Gorst(i) at L level, H level and L level, respectively, the scan line driver circuit 20 sets the control signal Gcmp(i) to H level in the period for writing as shown in FIG. 12. As being coupled with the one end of the holding capacitor 44 via the data line 14 at this time, the gate node g changes the voltage from the value (Vel−|Vth|) given in the period for compensation to a value shifted upwards by the voltage change ΔV on the node h multiplied by a capacitance ratio k2. That is, the voltage changes on the gate node g from the voltage (Vel−|Vth|) to the value (Vel−|Vth|+k2·ΔV) shifted upwards by the voltage change ΔV on the node h multiplied by the capacitance ratio k2.

Incidentally, the capacitance ratio k2 of the second embodiment is a capacitance ratio of Cdt, Crf1 and Crf2. The capacitance value Cpix of the holding capacitor 132 is neglected as described above.

Further, the voltage Vgs of the transistor 121 is expressed in an absolute value at this time as a value (|Vth|−k2·ΔV) which is the magnitude of the upward shift on the gate node g subtracted from the threshold voltage |Vth|.

Period for Light Emission

The period for light emission starts after the period for writing on the i-th row ends according to the second embodiment. As the scan line driver circuit 20 sets the control signal Gel(i) to L level in the period for light emission as described above, the transistor 124 is turned on in the pixel circuit 110 of the i-th row and (3j−2)-th column. The gate-source voltage Vgs is (|Vth|+k2·ΔV), a value shifted from the threshold voltage of the transistor 121 dependently on the voltage of the data signal. Thus, the OLED 130 is provided with a current according to the gradation level in condition that the threshold voltage of the transistor 121 is compensated as shown in FIG. 13.

The other pixel circuits 110 on the i-th row except for the pixel circuit 110 on the (3j−2)-th column simultaneously carry out the above operation in the period for scanning the i-th row. Further, the above operation on the i-th row is practically carried out in order of the first, second, third through (m−1)-th and m-th rows in a period for one frame and is repeated on a frame-by-frame basis.

According to the second embodiment, even if a minute current relatively significantly changes with respect to the gate-source voltage Vgs of the transistor 121 in the pixel circuit 110, the current to be provided to the OLED 130 can be precisely controlled similarly as the first embodiment.

According to the second embodiment, the voltage held by the parasitic capacitor which lives on the OLED 130 in the period for light emission can be initialized sufficiently. Besides, even if the threshold voltage of the transistor 121 varies in every one of the pixel circuits 110, display unevenness to degrade uniformity on a displayed screen is prevented from occurring and display of a high quality is resultantly enabled.

According to the second embodiment, the operation to make the holding capacitor 41 hold the data signal provided by the control circuit 5 via the demultiplexer 30 is carried out over the period for initialization and the period for compensation. A temporal limitation imposed on the operation to be carried out in one period for horizontal scanning can thereby be alleviated.

For instance, the current which flows through the transistor 121 decreases as the gate-source voltage Vgs comes close to the threshold voltage in the period for compensation, and thus it takes time until the voltage on the gate node g converges on (Vel−|Vth|). According to the second embodiment, though, a longer period for compensation can be secured as compared with the first embodiment as shown in FIG. 12. According to the second embodiment, variation in the threshold voltage of the transistor 121 can thereby be precisely compensated as compared with the first embodiment.

Further, the operation to provide the data signal can be slowed down.

Examples of Application and Modification

The invention is not limited to embodiments and so on such as the embodiments described above or application examples, and can be variously modified as described below. Further, any one or a plurality of modifications described below can be suitably combined with one another.

Control Circuit

Although it is supposed as to the embodiment that the control circuit 5 which provides a data signal is separate from the electrooptic device 10, the control circuit 5 may be integrated with the scan line driver circuit 20, the demultiplexer 30 and the level shift circuit 40 on the silicon substrate.

Further, the electrooptic device 10 may include the control circuit 5. In this case, the electrooptic device 10 has a driver circuit which drives the pixel circuit 110 and the driver circuit is provided with a driving control circuit which controls operations of the pixel circuit 110, the demultiplexer 30 and the level shift circuit 40.

Substrate

Although being structured on the silicon substrate according to the embodiments described above and so on, the electrooptic device 10 may be structured to be integrated on another substrate, e.g., an SOI substrate. Further, it may be formed on a glass substrate, etc., by means of an application of a polysilicon process. Either is an effective way for a structure in that the pixel circuit 110 is minutely processed and that the drain current exponentially and significantly changes with respect to the change of the gate-source voltage Vgs in the transistor 121.

Further, the invention may be applied in a case where the pixel circuit does not need to be minutely processed.

Demultiplexer

Although the structure of the embodiments described above and so on is such that every three columns of the data lines 14 are grouped and that the data lines 14 are chosen in turn in each of the groups and the data signal is provided, the number of the data lines forming a group may be a particular number between "2" and "3n". The number of the data lines forming a group may be, e.g., "2" or "4" and over.

Further, another structure without grouping, i.e., without the use of the demultiplexer 30 in that the data lines 14 of the respective columns are provided with data signals in order of the lines at the same time is allowable.

Channel Types of Transistors

Although the transistors 121-125 in the pixel circuit 110 of the embodiments described above and so on are of a uniform p-channel type, they may be of a uniform re-channel type. Further, those of p- and n-channel types may be suitably combined with one another.

Further, although the transistors 45 and 43 of the embodiments described above and so on are of p- and re-channel types, respectively, they may be of a uniform p- or n-channel type. Further, the transistors 45 and 43 may be of n- and p-channel types, respectively.

Others

Although the electrooptic element of the embodiments described above and so on is exemplified by the OLED which is a light emitting element, any element which emits light with brightness according to a current such as an inorganic light emitting diode or an LED (Light Emitting Diode) will do.

Electronic Apparatus

Then, an electronic apparatus to which the electrooptic device 10 of the embodiments and so on and application examples is applied will be explained. The electrooptic device 10 is fit for a use of small-sized pixels and high resolution display. Thus, a head mounted display will be explained as an example of the electronic apparatus.

Figure 17:
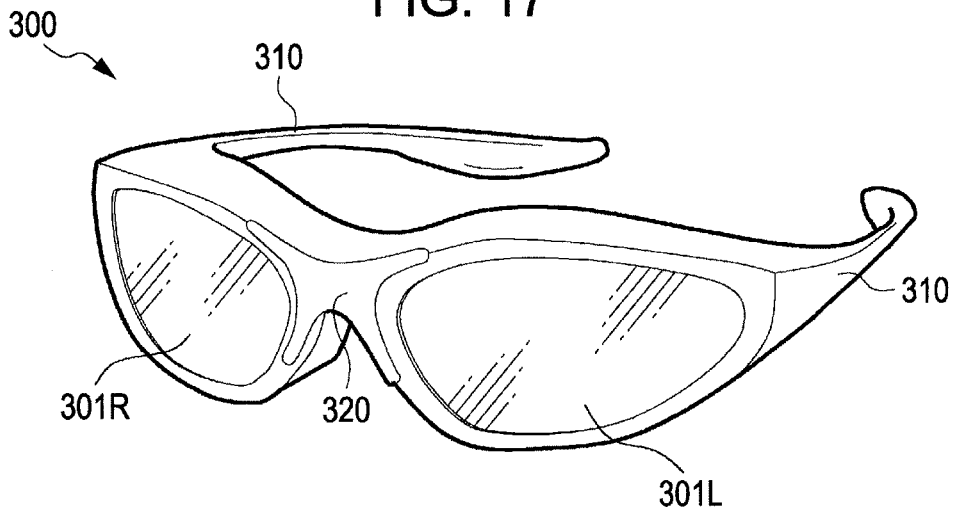
FIG. 17 is a perspective view which shows an HMD using the electrooptic device of the embodiments, etc.
Figure 18:
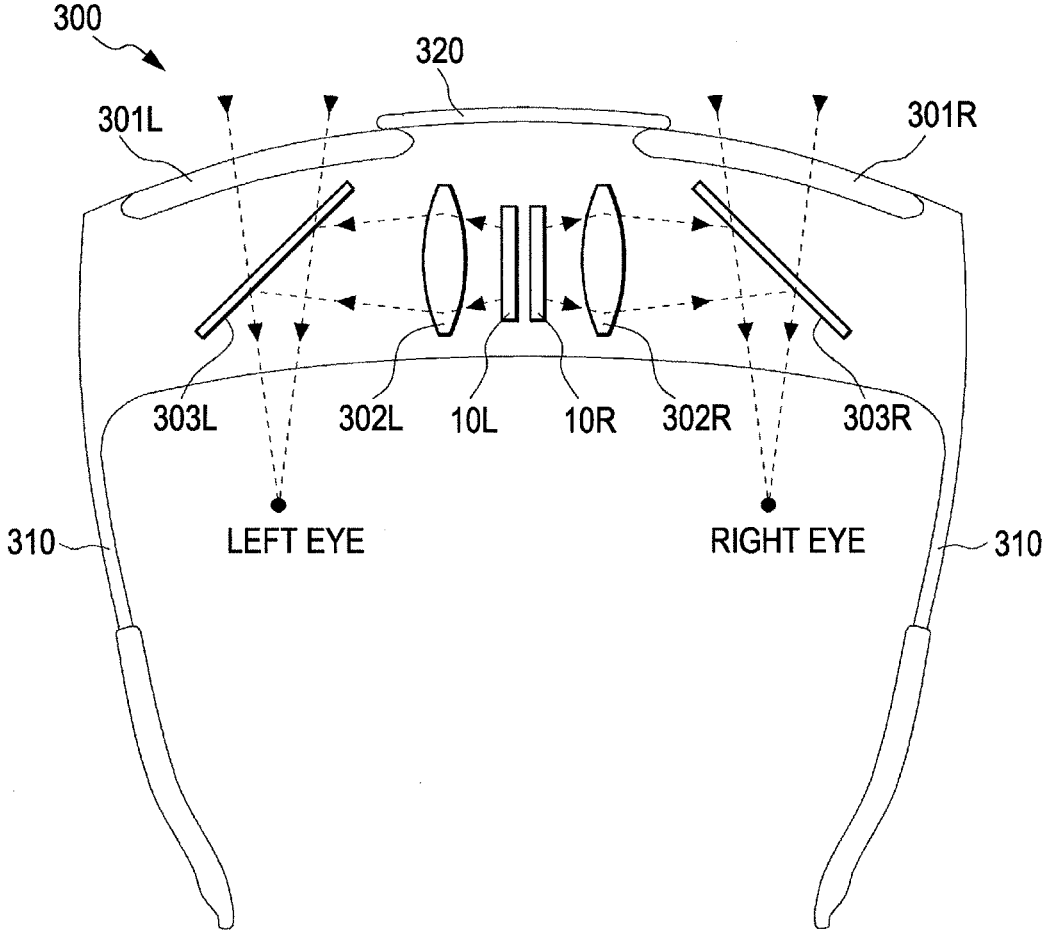
FIG. 18 shows an optical structure of the HMD.

FIG. 17 shows an external view of a head mounted display. FIG. 18 illustrates its optical structure.

As shown in FIG. 17, the head mounted display 300 has temples 310, a bridge 320 and lenses 301L and 301R similarly as an ordinary pair of glasses as viewed from the outside. Further, the head mounted display 300 is provided with an electrooptic device 10L for a left eye and an electrooptic device 10R for a right eye close to the bridge 320 and on the back of the lenses 301L and 301R (lower side in the drawing), respectively, as shown in FIG. 18.

An image display face of the electrooptic device 10L is arranged on the left in FIG. 18. An image displayed by the electrooptic device 10L thereby goes out via the optical lens 302L in the 9 o'clock direction in the drawing. A half mirror 303L makes light coming from 12 o'clock direction pass while reflecting the image displayed by the electrooptic device 10L in the 6 o'clock direction.

An image display face of the electrooptic device 10R is arranged on the right, opposite the electrooptic device 10L. An image displayed by the electrooptic device 10R thereby goes out via the optical lens 302R in the 3 o'clock direction in the drawing. A half mirror 303R makes light coming from 12 o'clock direction pass while reflecting the image displayed by the electrooptic device 10R go out in the 6 o'clock direction.

Someone wearing the head mounted display 300 of the above structure can observe an external scene overlaid with images displayed by the electrooptic devices 10L and 10R in see-through condition.

Further, if one of parallax images viewed by both eyes for the left eye is displayed on the electrooptic device 10L and another one of the images for the right eye on the electrooptic device 10R by the use of the head mounted display 300, the displayed image can be perceived as if having a depth or solidity (3D display).

Incidentally, the electrooptic device 10 can be applied to an electronic viewfinder of a video camera or a digital camera with interchangeable lenses except for the head mounted display 300.

The entire disclosure of Japanese Patent Application No. 2012-028097, filed Feb. 13, 2012 is expressly incorporated by reference herein.

What is claimed is:

1. An electrooptic device comprising a scan line, a data line and a pixel circuit provided correspondingly to a crossing of the scan line and the data line, and a driver circuit which drives the pixel circuit, wherein:

the pixel circuit includes a driving transistor, a writing transistor electrically coupled with and between a gate of the driving transistor and the data line, a first holding capacitor having one end electrically coupled with the gate of the driving transistor, the first holding capacitor being configured to hold a gate-source voltage of the driving transistor, and a light emitting element which emits light with brightness according to a current provided by the driving transistor;

the driver circuit includes a first feeder line, a level shift circuit electrically coupled with the data line, and a driving control circuit which provides the first feeder line with one of a first voltage and a second voltage, the driving control circuit being configured to control operations of the level shift circuit and the pixel circuit;

the level shift circuit includes a second holding capacitor, and a switch section;

the second holding capacitor has one end coupled with the data line and another end provided with a potential which specifies the brightness of the light emitting element; and the driving control circuit controls the switch section so as to electrically couple the first feeder line with the one end of the second holding capacitor in part or all of a period of time in which the first feeder line is provided with the first voltage, and controls the switch section so as to electrically couple the first feeder line with the other end of the second holding capacitor in part or all of a period of time in which the first feeder line is provided with the second voltage.

2. An electronic apparatus having the electrooptic device according to claim 1.

3. The electrooptic device according to claim 1 further comprising:

a third holding capacitor which holds a voltage on the data line.

4. The electrooptic device according to claim 3, wherein the driving control circuit:

controls the switch section in a first period of time so as to provide the first feeder line with the first voltage and to electrically couple the first feeder line with the one end of the second holding capacitor;

controls the switch section in a second period of time after the first period of time ends so as to provide the first feeder line with the second voltage and to electrically couple the first feeder line with the other end of the second holding capacitor in condition that the writing transistor is kept on; and electrically decouples the first feeder line with the both ends of the second holding capacitor and provides the other end of the second holding capacitor with the potential which specifies the brightness of the light emitting element in the condition that the writing transistor is kept on in a third period of time after the second period of time ends.

5. The electrooptic device according to claim 4, wherein:

the level shift circuit has a fourth holding capacitor;

the fourth holding capacitor is provided on one end with a potential according to a data signal that the driving control circuit outputs in a period of time since a start of the first period of time and until a start of the third period of time; and the fourth holding capacitor is coupled on one end with the other end of the second holding capacitor in the third period of time.

6. The electrooptic device according to claim 5, wherein:

the driver circuit has a first switch and a second switch provided correspondingly to the fourth holding capacitor;

an output end of the first switch is electrically coupled with the other end of the second holding capacitor;

an input end of the first switch is electrically coupled with the one end of the fourth holding capacitor and an output end of the second switch; and the driving control circuit turns the second switch on and provides the second switch on an input end with the data signal in condition that the first switch is kept off in the period of time since the start of the first period of time and until the start of the third period of time, and turns the first switch on in condition that the second switch is kept off in the third period of time.

7. The electrooptic device according to claim 6, wherein:

the electrooptic device has a particular number of data lines;

the driver circuit has a particular number of second holding capacitors, a particular number of fourth holding capacitors, a particular number of first switches and a particular number of second switches correspondingly to the particular number of the data lines;

input ends of the particular number of the second holding capacitors are coupled with one another in common; and the driving control circuit synchronizes the particular number of the second switches with supply of the data signal and turns the particular number of the second switches on in particular order.

8. The electrooptic device according to claim 7, wherein the driving control circuit turns the particular number of the first switches on at the same time in the third period of time.

9. The electrooptic device according to claim 4, wherein:

the pixel circuit has a threshold compensation transistor electrically coupled with and between the gate and a drain of the driving transistor; and the driving control circuit keeps the threshold compensation transistor on in the second period of time, and keeps the threshold compensation transistor off in the periods of time except for the second period of time.

10. The electrooptic device according to claim 9, wherein:

the second feeder line is provided along the data line; and the third holding capacitor is formed by the data line and the second feeder line.

11. The electrooptic device according to claim 4 further comprising a second feeder line which provides a particular reset voltage, wherein:

the pixel circuit has an initializing transistor coupled with and between the second feeder line and the light emitting element; and the driving control circuit keeps the initializing transistor on in at least a portion of the first period of time, second period of time and third period of time.

12. The electrooptic device according to claim 4, wherein:

the pixel circuit has a light emission control transistor electrically coupled with and between the driving transistor and the light emitting element; and the driving control circuit keeps the light emission control transistor off at least in a period of time since the start of the first period of time and until an end of the third period of time.

13. An electronic apparatus having the electrooptic device according to claim 4.

14. An electronic apparatus having the electrooptic device according to claim 3.

15. The electrooptic device according to claim 1, wherein the switch section includes:

a first transistor electrically coupled with and between the one end of the second holding capacitor and the first feeder line; and a second transistor electrically coupled with and between the other end of the second holding capacitor and the first feeder line.

16. An electronic apparatus having the electrooptic device according to claim 15.

17. An electrooptic device comprising a scan line, a first data line, a second data line, a first pixel circuit provided correspondingly to a crossing of the scan line and the first data line, a second pixel circuit provided correspondingly to a crossing of the scan line and the second data line, and a driver circuit which drives the pixel circuit, wherein:

each of the first pixel circuit and the second pixel circuit includes a driving transistor, a writing transistor electrically coupled with and between a gate of the driving transistor and the first data line or the second data line, a first holding capacitor having one end electrically coupled with the gate of the driving transistor, the first holding capacitor being configured to hold a gate-source voltage of the driving transistor, and a light emitting element which emits light with brightness according to a current provided by the driving transistor;

the driver circuit includes a first feeder line, a switch section, a second holding capacitor having a first end and a second end, a first switch having a first input end and a first output end coupled with the first end of the second holding capacitor, a third holding capacitor having a third end and a fourth end coupled with the first data line, a second switch having a second input end coupled with the first end of the second holding capacitor and a second output end coupled with the third end of the third holding capacitor, a fourth holding capacitor having a fifth end and a sixth end, a third switch having a third input end coupled with the first input end of the first switch and a third output end coupled with the fifth end of the fourth holding capacitor, a fifth holding capacitor having a seventh end and a eighth end coupled to the second data line, a fourth switch having a fourth input end coupled with the fifth end of the fourth holding capacitor and a fourth output end coupled with the seventh end of the fifth holding capacitor, a driving control circuit which provides the first feeder line with one of a first voltage and a second voltage, the driving control circuit:

controls the switch section in a first period of time so as to provide the first feeder line with the first voltage and to electrically couple the first feeder line with the fourth end of the third holding capacitor and the eighth end of the fifth holding capacitor;

controls the switch section in a second period of time after the first period of time ends so as to provide the first feeder line with the second voltage and to electrically couple the first feeder line with the third end of the third holding capacitor and the seventh end of the fifth holding capacitor;

turns the first switch on in condition that the second switch is kept off in a third period of time, turns the third switch on in condition that the fourth switch is kept off in a fourth period of time after the third period of time.

18. The electrooptic device according to claim 17, wherein the driving control circuit turns the second switch and the fourth switch on at the same time in condition that the first switch and the third switch are kept off in a fifth period of time after the fourth period of time.

19. An electronic apparatus having the electrooptic device according to claim 17.

20. A method for driving an electrooptic device having a scan line, a data line, a pixel circuit provided correspondingly to a crossing of the scan line and the data line, a first feeder line, and a second holding capacitor having one end coupled with the data line and another end provided with a potential which specifies brightness of a light emitting element, the pixel circuit having a driving transistor, a writing transistor electrically coupled with and between a gate of the driving transistor and the data line, a first holding capacitor having one end electrically coupled with the gate of the driving transistor, the first holding capacitor being configured to hold a gate-source voltage of the driving transistor, and a light emitting element which emits light with brightness according to a current provided by the driving transistor, the method comprising:

providing the first feeder line with a first voltage and electrically coupling the first feeder line with the one end of the second holding capacitor in a first period of time; and providing the first feeder line with a second voltage and electrically coupling the first feeder line with the other end of the second holding capacitor in a second period of time which starts after the first period of time ends.

* * * * *